United States Patent [19]

Arguello et al.

[11] Patent Number: 4,538,585

[45] Date of Patent: Sep. 3, 1985

[54] DYNAMIC IGNITION APPARATUS

[75] Inventors: Leonard E. Arguello, Sunnyvale; Lawrence M. Blaser, Mountain View; Verne H. Wilson, Belmont, all of Calif.

[73] Assignee: Fairchild Camera & Instrument Corporation, Mountain View, Calif.

[21] Appl. No.: 404,068

[22] Filed: Aug. 2, 1982

[51] Int. Cl.[3] ..... F02P 3/04

[52] U.S. Cl. ..... 123/609

[58] Field of Search ..... 123/609, 610, 611, 644, 123/632

[56] References Cited

U.S. PATENT DOCUMENTS

| | | | |
|---|---|---|---|
| 4,298,941 | 11/1981 | Furuhashi | 123/609 X |
| 4,329,970 | 5/1982 | Mowery | 123/425 X |
| 4,368,717 | 1/1983 | Roberts et al. | 123/632 |

*Primary Examiner*—Tony M. Argenbright

*Attorney, Agent, or Firm*—Carl L. Silverman; Clifton L. Anderson; David H. Carroll

[57] ABSTRACT

A digital and linear dynamic ignition control apparatus comprising a burn-time counter, a pre-dwell counter, a current limit counter, engine speed detection apparatus, a biasing circuit and an excess current limit circuit is provided for controlling the start of a dwell in each ignition period. In operation, a current limit adjust window is established for each period. The time of the termination of a dwell in the period relative to the current limit adjust window established for the period starts the dwell in the next period relative to the beginning of the next period at a time calculated to optimize engine performance and minimize energy losses. In general, rapid acceleration in a period starts the dwell earlier in the next period to insure adequate charging of the ignition coil. Conversely, rapid deceleration in a period starts the dwell later in the next period to minimize energy losses.

33 Claims, 9 Drawing Figures

INPUT AMPLIFIER AND TEST MODE CONTROL

CLOCK, INITIALIZATION AND RAMP GENERATOR

OUTPUT DRIVER, OCLIT, CLAMP, TACH OUTPUT, CLON DET, MPT DET

DYNAMIC IGNITION APPARATUS

The present invention relates to an ignition system for an internal combustion engine having an ignition coil and spark plug in general and in particular, to a dynamic ignition control apparatus for such engines.

BACKGROUND OF THE INVENTION

A conventional or Kettering ignition system used in an internal combustion engine makes use of mechanical breaker points which are opened and closed by a cam lobe driven by the engine to periodically interrupt the passage of electrical current through an ignition coil coupled thereto. The time when this current is interrupted must be synchronized with the optimum piston position within the cylinder for maximum mechanical torque and minimum exhaust emissions.

In operation, the spark plug firing time is initiated the moment the mechanical breaker points are separated by the cam lobe. In order to increase the life expectancy of the breaker points, the current which they must interrupt is typically reduced, thus decreasing the available energy in the system.

The time the coil is charged is defined in the conventional systems as the dwell angle. The dwell angle is a constant function of the configuration of the cam lobe and the mechanical breaker points. Because the dwell angle in a conventional system is independent of engine speed, at low engine speeds the coil may charge to a level higher than that required for optimum combustion thereby wasting energy and causing needless excessive wear of the breaker points. Conversely, at high engine speeds, the dwell angle in a conventional system is frequently insufficient for the coil to charge to the critical energy level required for optimum combustion.

SUMMARY OF THE INVENTION

In view of the foregoing, a principle object of the present invention is an ignition control apparatus which performs the basic function of the mechanical breaker points without the negative effects of mechanical wear.

Another object of the present invention is an ignition control apparatus with means for continuously adjusting the ignition coil current to the optimum level the system requires without negatively affecting the life expectancy of the apparatus.

Still another object of the present invention is an ignition control apparatus with means for continuously adjusting the dwell angle to maintain a constant amount of energy to the spark plug regardless of engine speed.

In accordance with the above objects, the apparatus of the present invention is usable in an inductive storage ignition system with a magnetic or Hall-effect transducer pickup device, a power Darlington coil driver and an inductive storage ignition coil. With its associated external components, the apparatus of the present invention, has the following features:

1. It accepts an input from the magnetic or Hall-effect pickup device with a wide tolerance in duty cycle.
2. It mainimizes power dissipation at low and constant engine speeds. During engine acceleration, the dwell angle is momentarily widened to minimize the number of missing or reduced high-voltage output pulses.
3. A digital time-out circuit shuts down the output stage to prevent excessive power dissipation when the ignition is ON with a stalled engine.

4. A clamp circuit limits the flyback voltage at the Darlington output to a safe level (375 V), should the ignition coil secondary be open-circuited.
5. Stable performance over a wide range of battery voltage and ambient temperature is achieved by operating critical circuitry from a temperature stable, 3-volt regulated supply.

BRIEF DESCRIPTION OF THE DRAWING

The above and other objects, features and advantages of the present invention will become apparent to those skilled in the art from the following detailed description of the accompanying drawing in which.

DETAILED DESCRIPTION OF THE DRAWING

Figure 1A:
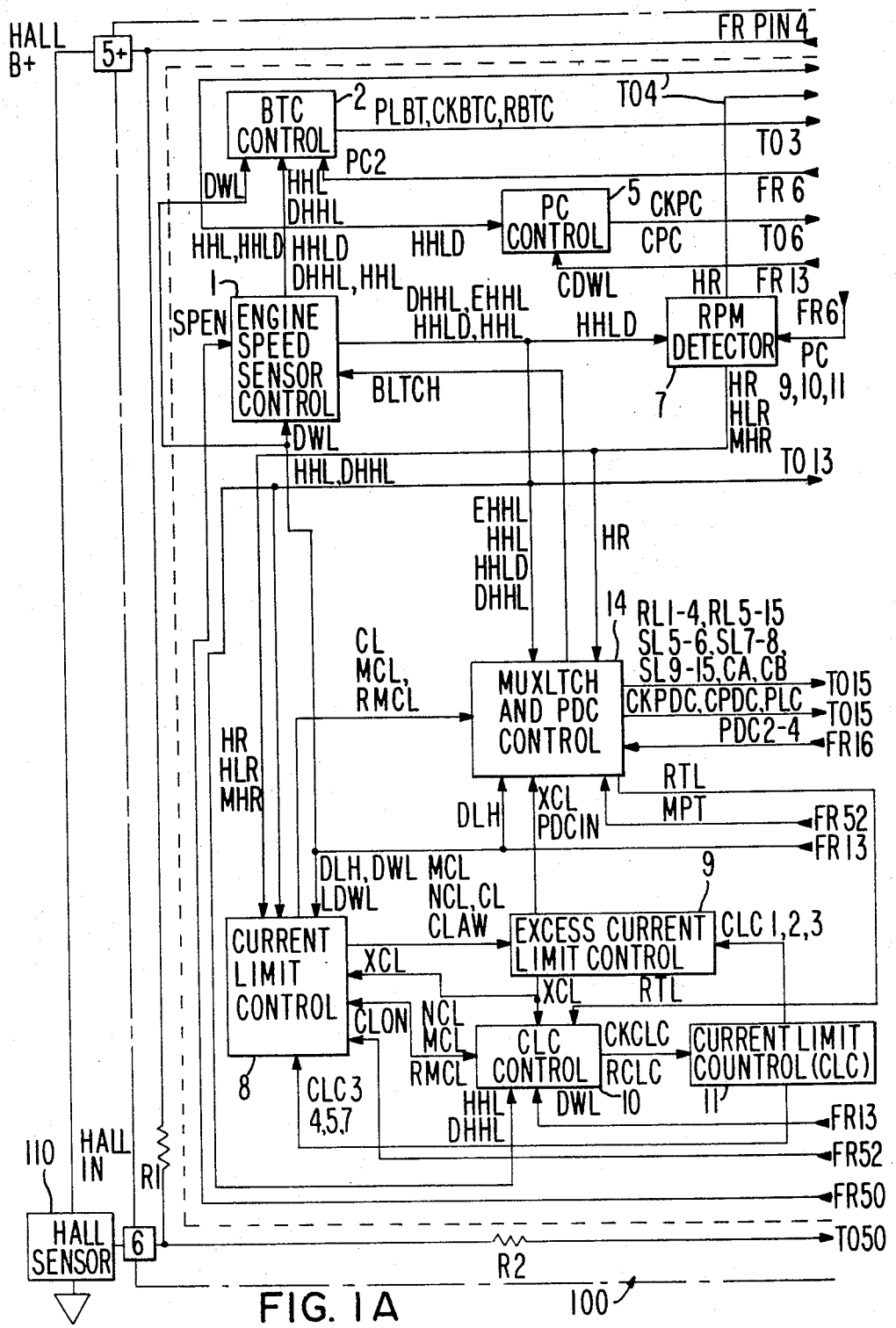
FIGS. 1A, 1B and 1C is a block diagram and schematic of an apparatus according to the present invention.
Figure 1B:
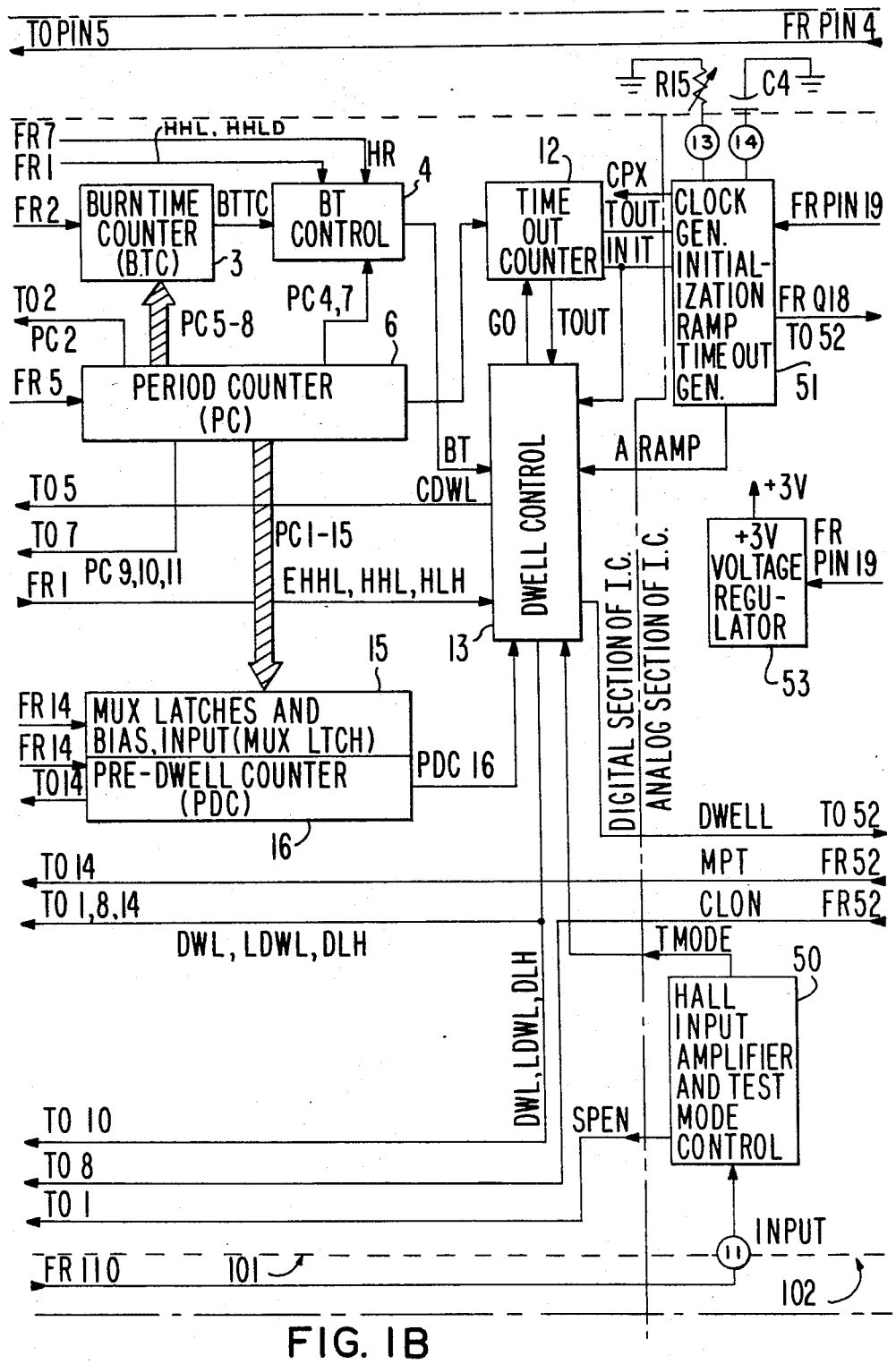
Figure 1C:
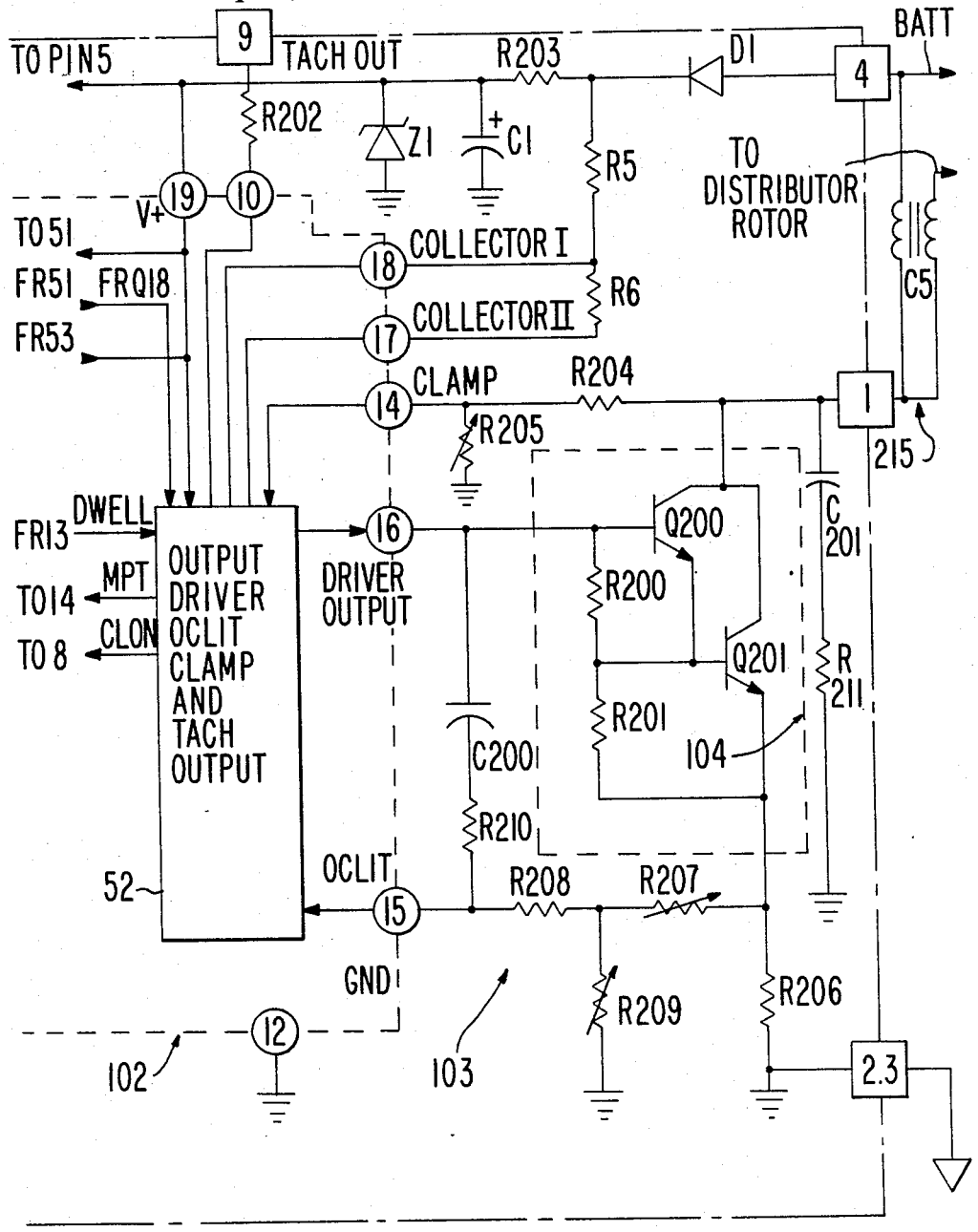

Referring to FIG. 1, there is provided in accordance with the present invention a dynamic hybrid ignition control apparatus 100. In the apparatus 100, there is provided a digital section 101, an analog or linear section 102, a Darlington output section 103, and a number of external circuit components coupled thereto to be described hereinafter.

An input to the apparatus 100 is derived from a Hall effect sensing device 110. A magnetic pickup can also be used. The device 110 is typically placed inside a distributor (not shown). A typical Hall-effect ignition sensor 110 is comprised of a Hall-effect sensor and a small permanent magnet molded together into a "U" shaped housing and placed facing each other on opposite sides of the "U" shaped housing. In practice, the sensor is placed in the distributor such that a ferrous shutter wheel can be mounted on the distributor cam and passed through the "U" shaped housing of the sensor. By cutting openings in the shutter wheel corresponding to the number of cylinders and required duty cycle, the required input signal containing the timing information required for optimum performance of the engine can be generated. The output of the Hall-effect sensor 110 is a rectangular pulse with a duty cycle approximately equal to the mark to space ratio of the ferrous shutter wheel.

The output of the Hall sensor 110 is applied to a Hall input pin 6 of the apparatus 100 and to a pair of resistors R1 and R2. The resistors R1 and R2 are termination and current limiting resistors, respectively. R1 reduces the input impedance of the system. R2 controls the current into a Hall input amplifier and Test Mode control circuit 50 coupled thereto by an input pin 11 of the linear section 102. In practice, R2 reduces the effects of high voltage transients induced by the environment into the Hall sensor input lines.

As will be further described below with respect to FIG. 4, there is provided in a clock generator, initialization ramp and time out generator circuit 51 in the linear section 102, a digital ignition system clock 203. The digital ignition system clock runs at a nominal 25 kHz and has a nominal 40 μs period comprising a high period of at least 30 μs and a low period of 10 μs. The high period is required to cover the ripple propagation time through the multiple stages of the system ripple counters. The clock frequency is adjusted by actively trimming a resistor R15 coupled to a pin 13 of the linear section 102 to compensate for nominal variations in a timing capacitor C4 coupled to a pin 14 of the section 102. The output of the linear section 102 is taken from an output driver pin 16 is coupled, via an emitter follower transistor Q200 into the base of a transistor Q201. Transistors Q200 and Q201 and a pair of resistors R200 and R201 comprises a Darlington circuit 104.

A pin 7 is provided for use as an output pin containing the engine speed information that can be used to drive a tachometer circuit or other form of speed indicator. A resistor R202 serves to protect the linear section 102 from induced high voltage noise on the tachometer line coupled to pin 7.

A diode D1 is provided in series with a main battery bus coupled to a pin 4 for preventing negative going transients of short duration from temporarily affecting the performance of the apparatus 100.

Coupled to the diode D1 there is provided a resistor R203, capacitor C1 and Zener diode Z1.

The resistor R203 and the capacitor C1, which maintains a charge during short duration negative going B+ transients, assure continuous module operation. Z1, a 20 V Zener diode, is used to limit the maximum voltage supplied to a Hall B+ line coupled thereto by a pin 5 during temporary high voltage excursions caused by field decay transients or other transients on the main battery bus. This precaution is needed since the Hall-effect transducer is rated at 24 V maximum continuous supply.

A pair of resistors R204 and R205 coupled by a pin 14 between an output pin 1 and an output driver, OCLIT, clamp and tach output circuit 52 form a voltage divider network used to set the maximum collector voltage excursion during ignition firing. A collector clamp circuit in the linear section 102, in conjunction with the VBE of the Darlington 104, form a voltage reference of approximately 17 V across resistor R205. The ratio of R205 to R204 is deliberately set so that the worst case collector sustaining voltage will always be higher than the maximum limit after trim. This insures that only R205 will have to be actively trimmed to force the voltage down. In practice, a collector voltage clamp temperature coefficient has been designed to approximately −170 PPM/deg C. typically for a change in collector clamp level of 6.3 V from +25 deg C. to +125 deg C. ambient temperature.

Figure 5A:
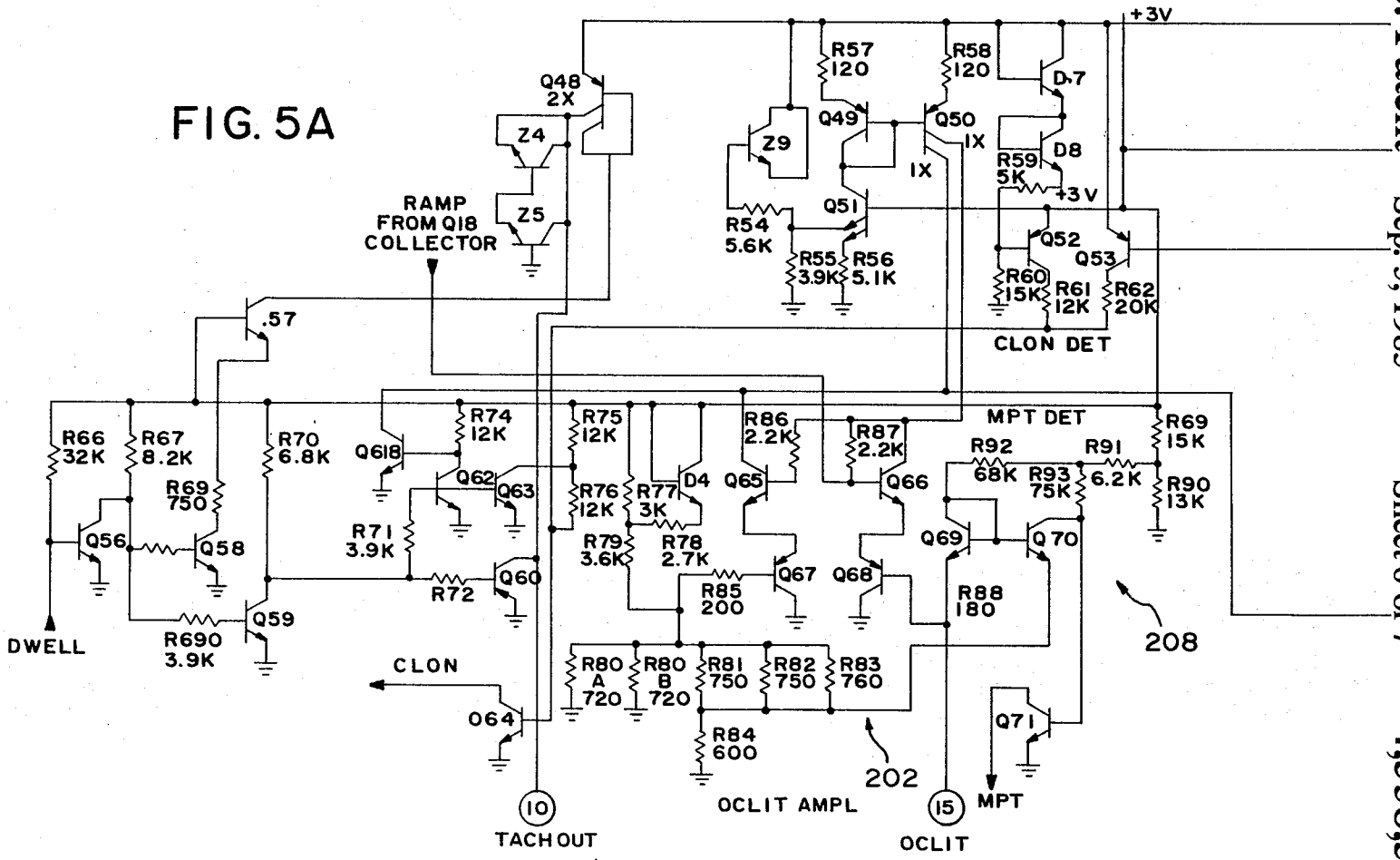
FIGS. 5*a* and 5*b* is a schematic of an output driver, OCLIT, clamp, tachometer output, CLON detector and MPT detector circuit according to the present invention.
Figure 5B:
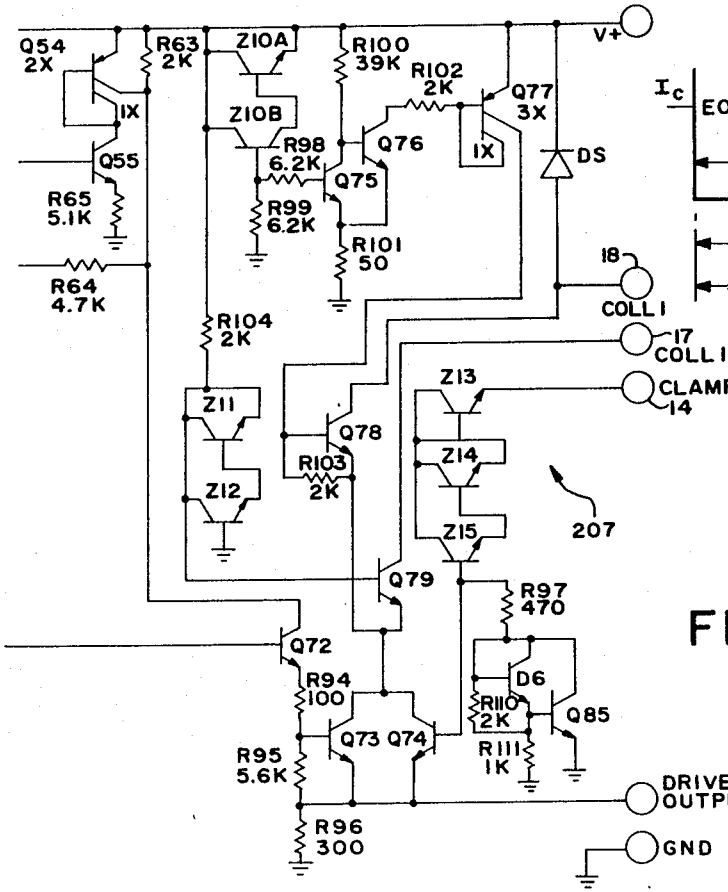

A plurality of resistors R206, R207, R208 and R209 coupled between an OCLIT input pin 15, an external ground via pins 2, 3 and the Darlington 104 form an output current limit input threshold feedback loop for an output current limit circuit (OCLIT) 202 in the circuit 52 (See FIG. 5). The voltage developed across R206 is divided down via R207 and R209, is applied to an OCLIT input pin 15, and compared with an internally generated OCLIT reference. The OCLIT circuit 202 when activated forces the output Darlington 104 out of saturation. This compensation will continue to keep the voltage across R206 constant. This action accomplishes output current limit control. By actively trimming R207 and R209, the same objective current level can always be achieved despite variations in sense resistor R206 or reference values. The output current limit temperature coefficient is accomplished by purposely designing in an OCLIT reference temperature coefficient which partially cancels the temperature coefficient of R206. A voltage coefficient of current limit depends on the line regulation performance of the OCLIT reference voltage. This parameter is also very much dependent upon voltage dependent ground drops which modulate the magnitude of the OCLIT reference.

A resistor R210 and a capacitor C200 are coupled between the driver output pin 16 and the OCLIT input pin 15 to form a lead-lag compensation network designed to ensure OCLIT loop stability. A resistor R211, in conjunction with a capacitor C201 coupled between the output pin 1 and ground performs a multiple function. C201 acts as a tuning element in conjunction with the primary inductance of an ignition coil 215 coupled thereto. This resonance effect serves to increase ignition coil secondary voltage slew rate, while also reducing the secondary effective source impedance. Clamp loop stability is ensured by adding R211 in series with C201, thus providing a zero in the loop transfer function.

Referring to the digital section 101 of the apparatus 100, there is provided an engine speed sensor control circuit 1. Coupled to an output of the circuit 1, there is provided a burn-time counter control circuit 2. Coupled to the output of the circuit 2, there is provided a burn-time counter (BTC) 3. Coupled to the output of the burn-time counter 3, there is provided a burn-time control circuit 4. Also coupled to an output of the circuit 1, there is provided a period counter control circuit 5. The output of the period counter control circuit 5 is coupled to a period counter (PC) 6. Coupled to still another output of the control circuit 1, there is provided an RPM detector 7. Coupled to an output RPM detector 7, there is provided a current limit control circuit 8. Coupled to an output of the current limit control circuit 8, there is provided an excess current limit control circuit 9. Coupled to an output of the circuit 9, there is provided a current limit counter control circuit 10. Coupled to an output of the circuit 10 there is provided a current limit counter (CLC) 11. Coupled to an output of the period counter (PC) 6 there is provided a time out control circuit 12. Coupled to an output control circuit 12 there is a dwell control circuit 13. Coupled to still another output of the engine speed sensor control 1 there is provided a multiplexing latch and predwell counter control circuit 14. Coupled to the output of the circuit 14 there is provided a multiplexing latch and bias input circuit 15 and a predwell counter (PDC) 16.

The digital section 101 receives a plurality of outputs from the linear section 102. The outputs comprise a speed of engine signal (SPEN) representing the Hall sensor output and a test mode signal (TMODE) used for gating the system clock onto the Dwell output of circuit 13 from the Hall input amplifier test mode control circuit 50, a current limit on (CLON) signal and a missing pulse threshold (MPT) signal from the output driver, OCLIT, clamp and tach output circuit 52, and the 25 kHz system clock (CPX) signal, an initialization signal (INIT) and ARAMP (after ramp) signal used to inhibit the Dwell output from the clock generator, initialization, and ramp time out generator circuit 51. In response to these signals, the digital section 101 provides to the linear section 102 a plurality of output signals. The output signals comprise a time out (TOUT) signal representing 1.3 seconds of SPEN input inactivity from the time out control circuit 12 and a system dwell (DWELL) signal from the dwell control circuit 13.

In the engine speed sensor control circuit 1, there are provided five D flip-flops comprising a first Hall flip-flop HL1; a second Hall flip-flop HL2, a Hall high-to-low delayed flip-flop HHLD, a delayed Hall high-to-low flip-flop DHHL, and an early Hall high-to-low flip-flop EHHL which is used to inhibit the DWELL output. In addition, there is provided in control circuit 1, a logic circuit for providing a plurality of output signals comprising: a Hall high-to-low, HHL signal and a Hall low-to-high, HLH signal.

The inputs to control circuit 1 comprise the SPEN signal from the Hall input amplifier of circuit 50, a dwell (DWL) signal from the dwell (DWL) flip-flop in the dwell control circuit 13 and a delayed bias latch (BLTCH) signal from the control circuit 14. The outputs of the control circuit 1 comprise DHHL, HHL, HHLD, DHHL, and HLH signals. For convenience, in the present description the input and output signals retain the designation of the flip-flops and logic circuit from which they emanate.

All of the flip-flops in the digital section 101 with the exception of the EHHL flip-flop are triggered on low-to-high transitions of the system clock CPX and CPX signals. For convenience the terms CPX and CPX will be used hereinafter in conjunction with the description of the setting and resetting of the system flip-flops to show the time when a particular flip-flop is set or reset. For example, the statement HL1 is set by SPEN (CPX), means that the SPEN signal sets the first Hall flip-flop on a low-to-high transition of the system clock CPX. Similarly, the statement, DHHL is set by HHL ($\overline{CPX}$), means that the HHL signal sets the delayed Hall high-to-low flip-flop DHHL on a low-to-high transition of the system clock $\overline{CPX}$. Similarly, the signals generated by the logic circuits described hereinafter are described using conventional logic nomenclature. For example, the equation, HLH=HL1 $\overline{HL2}$, means that the signal HLH is generated by HL1 and $\overline{HL2}$. Similarly, CPC=HHLD+CDWL, means the signal CPC is generated by HHLD or CDWL.

Figure 2:
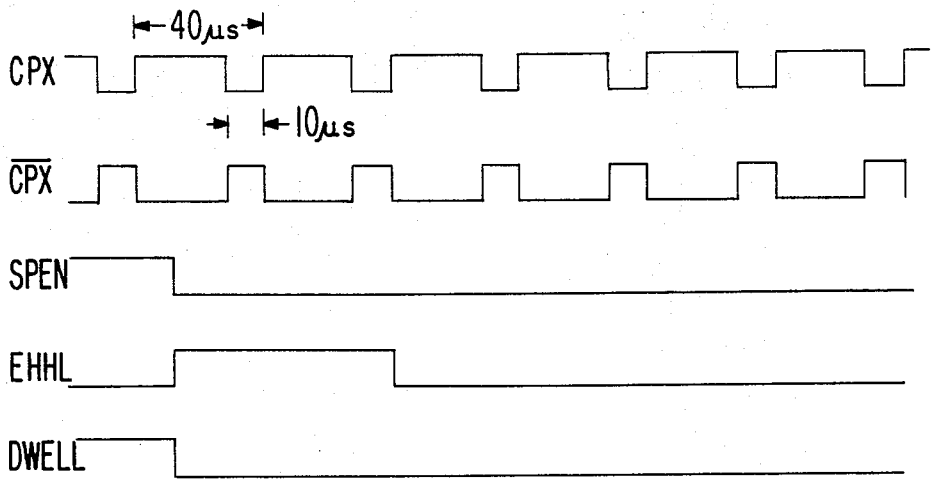
FIG. 2 is a timing diagram of the system clock CPX and $\overline{CPX}$ signals and the SPEN, EHHL and system dwell DWELL signals according to the present invention.

Referring to the timing diagrams of FIG. 2, the system clock CPX has a period of 40 μsecs of which 30 μsecs is high and 10 μsecs is low. A SPEN high-to-low transition sets the EHHL flip-flop asynchronously to turn off the system dwell DWELL. The other operations of the circuit 1 are defined by the following statements and equations:

HL1 is set by SPEN (CPX)

HL2 is set by HL1 (CPX)

HLH=HL1·$\overline{HL2}$ (only turns on dwell after Power on and after time out)

HHL=HL1·HL2

DHHL is set by HHL ($\overline{CPX}$)

HHLD is set by HHL (CPX)

EHHL is reset by $\overline{DWL}\cdot\overline{BLTCH}$ asynchronously.

In operation, flip-flops HL1 and HL2 sense changes in the SPEN level synchronously to generate HHL and HLH. The signal HLH is only used to turn on the first dwell after a power on initialization or after a time-out, as will be described below. It may be further noted by reference to the timing diagrams of FIG. 2 that the D flip-flop HL1 is reset at the first clock pulse following a transition of the SPEN signal from high-to-low. Similarly, the flip-flop HL2 is reset on the first clock signal following the resetting of HL1. This is consistent with the operation of D flip-flops in which the output follows the input with every clock pulse.

In the burn-time counter control circuit 2, there is provided a logic circuit. The inputs to the logic circuit are HHL, DHHL, DWL and the output of the second stage of the period counter 6, PC2. The outputs of the control circuit 2 comprise a parallel load burn-time counter control signal PLBT, the clock for the burn-time counter CKBTC, and a reset or clear signal RBTC for resetting (clearing) the burn-time counter BTC3. The logical equations describing the operation of circuit 2 are as follows:

CKBTC=PC·$\overline{DWL}\cdot\overline{DHHL}$

RBTC=HHL·$\overline{DHHL}$ (clears BTC3)

PLBT=HHL·$\overline{CPX}$ (loads BTC3).

In operation, the control circuit 2 loads the burn-time counter 3 at the beginning of each period with the complement of the contents of stages 5–8 of the period counter 6 under the control of the PLBT signal. Thereafter, the burn-time counter 3 is counted out using the clock signal CKBTC which is generated from PC2.

In the burn-time counter 3 there is provided a four-stage ripple counter. Its inputs comprise the CKBTC, RBTC, and PLBT signals from the burn-time counter control circuit 2 as well as the complement of stages 5–8 of the period counter 6, PC5–8. Its output comprises a burn-time counter terminal count signal BTTC for resetting a flip-flop in the burn-time control circuit 4.

As described above, in operation the burn-time counter 3 is cleared at the beginning of a period by RBTC. It is thereafter parallel loaded with $\overline{PC5\text{–}8}$ by PLBT and counted out by CKBTC to generate BTTC when all of its stages, BTC 1–4, are high. As further described below, the purpose of the burn-time counter 3 is to generate BTTC when the counter 3 has counted out approximately 25% of the previous period, provided that the engine speed in the previous period is greater than 3000 RPM.

In the burn-time control circuit 4 there is provided a burn-time D flip-flop BT used for selecting minimum burn-time. The inputs to the burn-time control circuit 4 comprise: BTTC from the burn-time counter 3, the contents of stages 4 and 7 of the period counter 6 (PC4, 7), a high RPM range signal HR from the RPM detector circuit 7, and the HHL and the HHLD signals. Its output comprises the burn-time signal BT.

The operation of the circuit 4 is described by the following statements:

BT is set by HHL+HHLD (CPX)

BT is reset by BTTC HR+PC4 PC7 (CPX)

As shown in the above statements the BT flip-flop is reset by BTTC and HR or by PC4 and PC7. The resetting of the BT flip-flop is the termination of the minimum burn-time. As will be described below with respect to the RPM detector 7, the signal HR is generated when the speed of the engine is above 3000 RPM. The stages PC4 and PC7 of the period counter 6 are set after the period counter 6 has counted for 3 milliseconds.

The burn-time control circuit 4 insures that following the end of a dwell and the firing of a spark plug there is sufficient time for the fuel to burn prior to the start of a new dwell. The burn-time control circuit thus described insures that the minimum burn-time will be at least 25% of the previous period for engine speeds above 3000 RPM or 3 milliseconds whichever is less.

In the period counter control circuit 5 there is provided a logic circuit. The inputs to the logic circuit comprises the signals HHLD and a clear dwell signal CDWL from the dwell control circuit 13. The outputs of control circuit 5 comprises a clock CKPC for clocking the period counter 6 and a clear period counter signal CPC for clearing the period counter 6. The logic equations describing the operation of the period counter control circuit 5 are as follows:

CKPC=CPX

CPC=HHLD+CDWL

As is apparent, the period counter control circuit 5 controls the operation of the period counter 6.

In the period counter 6 there is provided a 15 stage ripple counter. The inputs to the ripple counter comprise the signals CKPC and CPC. The outputs of the counter 6 comprise PC1–15.

The period counted in the period counter 6 extends from the termination of a dwell to the termination of the next dwell. In other words, the period extends from a SPEN high-to-low transition to the following SPEN high-to-low transition. Except when cleared, the period counter 6 counts out the length of the period.

In the RPM detector circuit 7 there is provided four JK flip-flops comprising a high/low RPM range flip-flop HLR, a medium/high RPM range flip-flop MHR, a high/low RPM range sense flip-flop HLRS and a medium/high RPM range sense flip-flop MHRS. There is also provided in the RPM detector circuit 7 a logic circuit for generating the high RPM range signal HR. The inputs to detector circuit 7 comprise HHLD and stages 9, 10 and 11 of the period counter 6 PC 9, 10, 11. The outputs of the detector circuit 7 comprise the signals HR, HLR and MHR. The output of the logic circuit, HR, is defined by the statement HR=HLR MHR. The remaining operations of the detector circuit 7 are defined by the following statements:

HLRS is set by HHLD+(PC10 PC11) (CPX)

HLRS is reset by MHRS·PC9 (CPX)

MHRS is set by HHLD (CPX)

MHRS is reset by PC10 (CPX)

HLR is set by HLRS·HHLD (CPX)

HLR is reset by $\overline{\text{HLRS}}$·HHLD (CPX)

MHR is set by MHRS HHLD (CPX)

MHR is reset by $\overline{\text{MHRS}}$·HHLD (CPX)

In operation, at the beginning of each period, the contents of the sense flip-flops HLRS and MHRS are gated into the holding flip-flops HLR and MHR, respectively. Thereafter the sense flip-flops HLRS and MHRS are set. During the period, the holding flip-flops HLR and MHR reflect four possible speed ranges obtained by the engine during the prior period, i.e., the 0–500 RPM, 500–1500 RPM, 1500–3000 RPM, and speeds above 3000. At the same time that the holding flip-flops HLR and MHR are holding the speed range of the engine achieved during the prior period, the sensing flip-flops HLRS and MHRS detect the highest speed range of the engine achieved during the current period.

In the current limit control circuit 8 there are provided three flip-flops: a current limit control JK flip-flop CL used for storing the "current limit on" input signal CLON, a reset minimum current limit control D flip-flop RMCL and a minimum current limit control JK flip-flop MCL used to divide the current limit adjust window into two halves. There is also provided in the current limit control circuit 8 logic circuitry for developing a current limit adjust window signal CLAW and a no current limit during dwell signal NCL. The inputs to the current limit control circuit 8 comprise CLON, HHL, DHHL, HR, HLR, MHR, DLH, DWL, a late dwell flip-flop signal LDWL, an excess current limit control flip-flop signal XCL, the outputs of stages 3, 4, 5 and 7 of the current limit counter CLC3, 4, 5, 7, and the system clock CPX. The outputs of the current limit control circuit 8 comprise CL, RMCL, MCL, NCL, and CLAW.

The generation of the output signals is defined by the following logic equations and statements of the operation of the current limit control circuit 8.

MCL is set by $\overline{\text{DWL}}$ ($\overline{\text{CPX}}$)

NCL=$\overline{\text{CL}}$·$\overline{\text{XCL}}$·DWL·$\overline{\text{DHHL}}$

CL is set by CLON·NCL·$\overline{\text{DLH}}$ (CPX) ($\overline{\text{DLH}}$ prevents setting CL when DWELL starts)

CLAW=CLC3 HR DWL+CLC4 MHR DWL+CLC5·CLC4·$\overline{\text{HLR}}$+CLC7

RMCL is set by CLAW·$\overline{\text{DHHL}}$ (CPX)

MCL is reset by RMCL ($\overline{\text{CPX}}$)

RMCL is reset by $\overline{\text{CLAW}}$ (CPX)

CLAW=XCL

RMCL is set by CLAW·$\overline{\text{DHHL}}$ (CPX)

CL is reset by XCL·CLC4·DWL (CPX)

At the end of the period

CL is set by XCL·HHL (asynchronously)

CLAW=HHL

RMCL is reset by $\overline{\text{DWL}}$ (asynchronously)

MCL is set by $\overline{\text{DWL}}$ ($\overline{\text{CPX}}$)

CL is reset by $\overline{\text{LDWL}}$ (CPX)

In operation, with MCL and NCL, the control circuit 8 waits for the CLON signal. When CLON signal occurs, the current limit flip-flop CL is set starting the current limit adjust window. The control circuit 8 then waits for the arrival of the midpoint of the current limit adjust window which is indicated by the generation of the CLAW signal. The CLAW signal causes the RMCL flip-flop to set, which in turn causes the MCL flip-flop to reset. The MCL flip-flop being reset indicates that the second half of the current limit adjust window has been reached. After the CLAW signal, the control circuit 8 then waits for the end of the current limit adjust window which is indicated again by the CLAW signal. At that time the excess current limit period is entered, indicated by the XCL input. After eight bits of excess current limit, the current limit flip-flop CL is reset. When the flip-flop CL is reset the system is then controlled by the excess current limit control circuit 9.

In the excess current limit control circuit 9 there is provided one D flip-flop, the excess current limit control flip-flop XCL. In control circuit 9 there is also provided a logic circuit for providing the predwell counter inhibit signal PDCIN. The inputs to the control circuit 9 comprise NCL, CL, CLAW, MCL, and stages 1, 2 and 3 of the current limit counter CLC1, 2, 3. The outputs of the control circuit 9 comprise the XCL and the PDCIN signals.

The generation of the output signals of the control circuit 9 are defined by the following logical equations and statements of operation.

$PDCIN = NCL$

XCL is set by $CLAW \cdot \overline{MCL}$ $(\overline{CPX})$ $PDCIN = (CLC1 + CLC2 + CLC3) \cdot XCL \cdot \overline{CL}$ At the end of the period XCL is set by CLAW (CPX)

XCL is reset by MCL $(\overline{CPX})$

In operation, the XCL flip-flop is set at the end of the current limit adjust window. After the first eight counts of excess current limit, the PDCIN signal inhibits the pre-dwell counter PDC seven out of eight counts until the end of the period. The effect of the inhibiting function is to start the dwell earlier in each succeeding period until the system is out of the excess current limit period. For convenience this is called "walk back".

In current limit counter control circuit 10 there is provided a logic circuit for generating a clock input CKCLC for the current limit counter 11 and a reset (clear) current limit counter signal RCLC for clearing the current limit counter CLC 11. The inputs to the control circuit 10 comprise NCL, RMCL, MCL, XCL, a rise-time latch signal RTL, DWL, HHL, and DHHL. The outputs of the current limit control circuit 10 comprise CKCLC, and RCLC.

The operation of the control circuit 10 is defined by the following logical equations.

$RCLC = NCL$ (clears current limit counter)

$CKCLC = CPX \cdot DWL \cdot \overline{RTL} \cdot \overline{DHHL}$ $RCLC = RMCL \cdot MCL \cdot DWL \cdot \overline{DHHL}$ (midpoint)

$RCLC = XCL \cdot \overline{RMCL} \cdot DWL\ \overline{DHHL}$ (end of window)

The control circuit 10 controls the current limit counter 11. The signal RCLC clears the current limit counter at the beginning of the current limit adjust window, at the midpoint of the current limit adjust window and at the end of the current limit adjust window.

In current limit counter 11 there is provided a seven stage ripple counter. The inputs to the counter 11 comprise CKCLC and RCLC. The outputs comprise stages 1 through 5 and stage 7, CLC 1–5, 7.

In operation, when the current limit counter is not cleared it is counting.

In the time-out control circuit 12 there is provided a time-out JK flip-flop TOUT. The inputs to the control circuit 12 comprise stages 9 through 15 of the period counter 6 PC9–15, the INIT signal from the circuit 51 and a GO signal from the dwell circuit 13. The output of the time-out control circuit 12 comprises the time-out signal TOUT.

The operation of the control circuit 12 is defined by the following statements:

TOUT is reset by INIT (asynchronously)

TOUT is set by PC9–15 "anded" (CPX)

TOUT is reset by GO (CPX)

In operation the control circuit 12 generates the TOUT signal if the SPEN signal does not change state from high-to-low for 1.3 seconds, in other words, when the ignition switch is "on" and the engine is not running. The TOUT signal is supplied to the linear section 102 to discharge the coil 215 if the system DWELL is high at the time. This conserves power and prevents excessive heating of the output circuits.

In the dwell control circuit 13 there is provided three flip-flops. A dwell JK flip-flop DWL, a late dwell D flip-flop LDWL and a clear dwell JK flip-flop CDWL. There is also provided in control circuit 13 logic circuitry for generating the GO signal, the dwell low-to-high signal DLH, and the system dwell signal DWELL. The inputs to the control circuit 13 comprise INIT, the test mode signal TMODE, the after ramp input signal ARAMP used to inhibit the DWELL output, EHHL, HHL, HLH, stage 16 of the pre-dwell counter PDC16, BT, and TOUT. The outputs of the control circuit 13 comprise DWL, LDWL, CDWL, GO, DLH, and DWELL.

The operation of the dwell control circuit 13 to initiate the first dwell, during normal operation, and after timeout and the system clock CPX resumes, is defined by the following logical equations and statements of operation.

DWL and LDWL are reset by INIT(asynchronously)

CDWL is set by INIT (asynchronously)

$GO = CDWL \cdot HLH$

DWL is set by GO (asynchronously)
CDWL is reset by GO (CPX)

FIRST DWELL AND NORMAL OPERATION $\text{DWELL} = \text{DWL} \cdot \overline{\text{EHHL}} \cdot \overline{\text{ARAMP}} \cdot \overline{\text{TMODE}} + \text{TMODE CPX}$ $\text{DLH} = \text{DWL} \cdot \overline{\text{LDWL}}$ LDWL is set by DWL (CPX)

DWL is reset by HHL (CPX)

LDWL is reset by $\overline{\text{DWL}}$ (CPX)

DWL is set by $\text{PDC16} \cdot \overline{\text{BT}} \cdot \overline{\text{CDWL}} \cdot \overline{\text{HHL}}$

RETURN TO DWELL

AFTER A TIMEOUT AND CPX RESUMES

CDWL is set by TOUT (CPX)

DWL is reset by CDWL (CPX)

GO = CDWL HLH

DWL is set by GO (asynchronously)

CDWL is reset by GO (CPX)

$\text{DWELL} = \text{DWL}\ \overline{\text{EHHL}}\ \overline{\text{ARAMP}}\ \overline{\text{TMODE}} + \text{TMODE CPX}$ $\text{DLH} = \text{DWL} \cdot \overline{\text{LDWL}}$ LDWL is set by DWL (CPX)

DWL is reset by HHL (CPX)

LDWL is reset by $\overline{\text{DWL}}$ (CPX)

DWL is set by $\text{PDC 16} \cdot \overline{\text{BT}} \cdot \overline{\text{CDWL}} \cdot \overline{\text{HHL}}$ (CPX)

RETURN TO DWELL

In operation, the ARAMP signal from the dwell control circuit 13 prevents a DWELL signal after the system clock CPX resumes following a timeout until a SPEN low-to-high transition occurs. This is necessary to prevent premature charging of the ignition coil.

During normal operation DWL is set as a result of the pre-dwell counter PDC counting out and the minimum burntime having elapsed. The DWL flip-flop having been set produces the system dwell signal DWELL. When a SPEN high-to-low transition occurs, EHHL is set asynchronously which turns off the system dwell DWELL immediately. At this time the HHL flip-flop resets the DWL flip-flop until DWL is again set. The generation of DWL and $\overline{\text{LDWL}}$ generates DLH which is used to gate $\overline{\text{PC}}$ into the pre-dwell counter PDC.

During the power on initialization, the initialization caused the INIT signal. The INIT signal clears the DWL, LDWL, and TOUT flip-flops and sets the CDWL flip-flop. The CDWL flip-flop clears the period counter 6. Thereafter the system waits for a SPEN low-to-high transition which generates the HLH signal. Thereafter the GO signal is generated. GO being defined by GO=CDWL·HLH.

Time-out occurs when the TOUT flip-flop is set after there has been no high-to-low change in the SPEN signal for 1.3 seconds. The TOUT flip-flop is set by stages 9–15 of the period counter 6, PC 9–15 going high. The setting of the TOUT flip-flop removes the system clock CPX for 20 milliseconds. During this time the ignition coil is discharged. If the system dwell DWELL is high at the time, it remains high until the system clock CPX resumes to prevent spiking in the output. After the system clock CPX resumes, the system operates as defined by the following equation and statements of operation.

TOUT sets CDWL (CPX)

CDWL resets DWL (CPX)

Once the CDWL flip-flop is set the system waits for a SPEN low-to-high transition. When the SPEN low-to-high transition occurs, the GO signal is produced as follows:

GO=CDWL·HLH

In the multiplexing latch and pre-dwell counter control circuit 14, there is provided four D flip-flops; a parallel load flip-flop PLF for loading the pre-dwell counter 16 and the multiplexing latches (MUXLATCHES) 15, an early parallel load flip-flop EPLF for loading the pre-dwell counter 16 and the muxlatches 15, a delayed bias flip-flop DBF and a pre-dwell counter inhibit flip-flop PDCINF; a delayed AMP5 JK flip-flop DAMP5 which is used for storing the MPT input; and a pair of latches comprising a delayed bias latch BLTCH and a rise-time latch RTL. In the control circuit 14 there is also provided logic circuitry for generating a muxlatch input control signal CA for controlling the inputs from the period counter 6, a muxlatch input control signal CB for controlling the inputs from the pre-dwell counter 16, the reset muxlatch control signal RL for resetting the latches 15, a reset latch control signal for the 15 muxlatches RL 1–15, a set latch control signal for latches 5–15 of the muxlatches 15 SL 5–15, a muxlatch control signal ZRL for inhibiting the pre-dwell counter clock CKPDC, a pre-dwell counter bias control signal BIAS, a no DMAX bias control signal NODMAX, a no X BIAS control signal NOXBIAS, a clock input CKPDC for clocking the pre-dwell counter 16, a parallel load control signal PLC for loading the pre-dwell counter 16, and a clear pre-dwell counter signal CPDC for clearing the pre-dwell counter 16. The inputs to the control circuit 14 comprise EHHL, HHL, HHLD, DHHL, CL, RMCL, MCL, DLH, XCL, PDCIN, HR, PDC2–4, and MPT. The outputs of the control circuit 14 comprise CA, CB, RL, SL, CKPDC, CPDC, and PLC.

The operation of the control circuit 14 is described by the following logical equations and statements of operation.

Initially, DLH occurs following a power on GO signal.

RTL latch is set by DLH (asynchronously) (prevents premature counting of CLC 11 following rise time)

EPLF set by DLH ($\overline{\text{CPX}}$)

$\overline{\text{ZRL}}$=EPLF+PLF

PDCINF is set by $\overline{\text{ZRL}}$ (inhibits PDC clock)

CKPDC=CPX·$\overline{\text{PDCINF}}$

CA=DLH·$\overline{\text{CPX}}$ (Loads PC1–15 into MUXLATCHES 15)

PLF is set by DLH (CPX)

CPDC=EPLF·PLF·$\overline{\text{CB}}$ (clears PDC1–16)

EPLF is reset by $\overline{\text{DLH}}$ ($\overline{\text{CPX}}$)

PLC=PLF·$\overline{\text{CPX}}$ (Loads $\overline{\text{MUX1–15}}$ 15 into PDC1–15)

PLF is reset by $\overline{\text{DLH}}$ (CPX)

ZRL=$\overline{\text{EPLF·PLF}}$ $RL1\text{-}15=\overline{EPLF}\cdot\overline{PLF}\cdot\overline{PLC}$ PDCINF is set by PDCIN ($\overline{CPX}$) (inhibits PDC 16 during rise time)

During Rise Time

DAMP5 is set by MPT (CPX) (if 5½ amps in coil achieved)

PDCINF is reset by $\overline{PDCIN}$ ($\overline{CPX}$) (CKPDC resumes)

RTL is reset by $\overline{PDCINF}$ (asynchronously) (to start CLC 11)

A. At the Middle of the Current Limit Adjust Window

EPLF is set by $RMCL\cdot\overline{XCL}\cdot\overline{HHL}$ ($\overline{CPX}$)

$CB=RMCL\ \overline{XCL}\ \overline{HHL}\ \overline{CPX}$ (Loads PDC1-15 into MUXLATCHES 15)

$\overline{ZRL}=EPLF+PLF$

PDCINF is set by $\overline{ZRL}$ (inhibits PDC clock asynchronously)

PLF is set by $RMCL\cdot\overline{XCL}\cdot\overline{HHL}$ (CPX)

$CPDC=EPLF\cdot PLF\cdot\overline{CB}$ (clears PDC1-16)

EPLF is reset by $\overline{RMCL\cdot XCL\cdot HHL}$ ($\overline{CPX}$)

$PLC=PLF\cdot\overline{CPX}$ (Loads MUX1-15 into PDC1-15)

PLF is reset by $\overline{RMCL\cdot XCL\cdot HHL}$ ($\overline{CPX}$)

$ZRL=\overline{EPLF}\cdot\overline{PLF}$ $RL1\text{-}15=\overline{EPLF}\cdot\overline{PLF}\cdot\overline{PLC}$ PDCINF is reset by $\overline{PDCIN}$ ($\overline{CPX}$) (resumes PDC clock)

B. At the End of the First 8 Counts of XCL

PDCINF is set by PDCIN ($\overline{CPX}$) (inhibits PDC 7 out of 8 CPX bits achieves proportional walk-back)

PDCINF is reset by $\overline{PDCINF}$ ($\overline{CPX}$) (resumes PDC for counting)

C. At the end of the Period, when HHL occurs after more than 8 counts of XCL

EPFL is set by $HHLD\cdot XCL$ ($\overline{CPX}$)

$CB=HHLD\ XCL\cdot\overline{CPX}$ (Loads PDC1-15 into MUXLATCHES 15)

$\overline{ZRL}=EPLF+PLF$

PDCINF is by $\overline{ZRL}$ (inhibits PDC clock, asynchronously)

PLF is set by $HHLD\cdot XCL$ (CPX)

$CPDC=EPLF\ PLF\ \overline{CB}$ (Clears PDC1-16)

EPLF is reset by $HHLD\cdot XCL$ ($\overline{CPX}$)

$PLC=PLF\cdot\overline{CPX}$ (Loads MUX1-15 into PDC1-15)

PLF is reset by $HHLD\cdot XCL$ (CPX)

$ZRL=\overline{EPLF}\cdot\overline{PLF}$ $RL1\text{-}15=\overline{EPLF}\cdot\overline{PLF}\cdot\overline{PLC}$ PDCINF is reset by $\overline{PDCIN}$ ($\overline{CPX}$) (resumes PDC clock)

Following the resetting of PDCINF, the system waits for a DLH signal. This first time at the end of the period the PDC 16 contains a zero count modified by acceleration and deceleration. Thereafter, PDC 16 at the end of the period contains the previous pre-dwell count modified by acceleration and deceleration.

If the end of the period identified by the HHL signal occurs before 8 counts of XCL, the proportional walk-back of B does not occur because PDCIN does not occur as described in B.

If HHL occurs at or before Midpoint, neither A, B or C occurs. A does not occur because RMCL does not occur. B does not occur because PDCINF does not occur. C does not occur because XCL does not occur.

If HHL occurs before midpoint, Bias is established.

$BIAS=MCL\cdot DHHL\cdot(\overline{HHLDXCL})$

MCL indicates that the midpoint was not reached by the end of the period

Bias is established by setting 1's in PDC 16. It is possible to set all 1's on top of pre-existing 1's in which event the Bias would not change the PDC. To avoid this condition, Bias is delayed two bit times when PDC 2, 3 and 4 are set as follows:

$RL=\overline{EPLF}\cdot\overline{PLF}\cdot\overline{PLC}$

BLTCH set by $BIAS\cdot HHL\cdot PDC\ 2\text{-}3\text{-}4$ (asychronously)

$NOXBIAS=CL\cdot(BIAS+DBF)$ $NODMAX=DAMP5\cdot(BIAS+DBF)$ $RL1\text{-}4=RL$ $SL5\text{-}6=NOXBIAS\cdot HR$ $SL7\text{-}8=NOXBIAS$ $SL9\text{-}15=NODMAX$ $RL5\text{-}15=RL\cdot\overline{SL5\text{-}15}$ DBF is set by BLTCH (CPX)

$PLC=BIAS\cdot HHLD\cdot\overline{EHHL}$ (normal Bias is injected)

BLTCH is reset by $\overline{LDWL}$ (asynchronously)

$PLC=DBF\cdot\overline{HHLD}\cdot\overline{CPX}$ (Delayed Bias is injected)

DBF is reset by $\overline{BLTCH}$ (CPX)

When Bias is established normally, functionally the contents of the PDC 1-15 are OR'd with the one's complement of the MUX latches 1-15 and the result is loaded in PDC 1-15.

During the special condition requiring delayed bias, the same thing including all 1's in PDC 1-4 occurs, but two bit times later. After the PDC has been incremented twice before bias is injected, there is assurance that the Bias injected in PDC 1-4 will change the PDC by at least one bit in the Bias direction, or in other words, that the contents of the PDC will be increased by at least 1 bit due to BIAS.

The amount of Bias that is required depends on the engine speed and when the end of the period occurs during the preceding period as follows:

If Bias is established, at least PDC 1-4 are loaded with 1's

If Bias is established and the RPM is less than 3000, i.e., $\overline{HR}$, then PDC1-6 are loaded with 1's If Bias is established and CLON has not occurred, i.e., $\overline{CL}$, then PDC1-8 are loaded with 1's If Bias is established and MPT has not occurred, i.e., $\overline{DAMP5}$, then PDC1-15 are loaded with 1's In the MUX Latches and BIAS input circuit 15, there are provided 15 latches L1-15. The inputs to the circuit 15 comprise CA, CB RL1-4, RL5-15, SL5-6, SL7-8, SL9-15, PC1-15, and PDC1-15. The output of circuit 15 comprises the 15 stages of the MUX latches complemented $\overline{L1\text{-}15}$.

The setting and resetting of the MUX latches L1-15 are described in the following statements:

L1-15 are reset by RL1-4, RL5-15 (asynchronously)

Upon a DWL low-to-high transition

L1-15 are set by CA·PC1-15 (asynchronously)

After the transfer to PDC 1-15

L1-15 reset by RL1-4, RL5-15 (asynchronously)

If the period ends after the Midpoint of Window at RMCL·$\overline{XCL}$

L1-15 are set by CB·PDC1-15 (asynchronously)

After the transfer to PDC 1-15

L1-15 are reset by RL1-4, RL5-15 (asynchronously)

At end of Period, when HHLD·XCL occurs

L1-15 are set by CB·PDC1-15 (asynchronously)

After the transfer to PDC 1-15

L1-15 are reset by RL1-4, RL5-15 (asynchronously)

If the period ends before midpoint of window when Bias or delayed Bias are established L5-6, L7-8, L9-15 are set by SL5-6, SL7-8, SL9-15, respectively (asynchronously)

After the transfer to the PDC 1-15

L1-5 are reset by RL1-4 and RL5-15 (asynchronously)

In the predwell counter 16 there is provided a 16 stage ripple counter. Inputs to the counter 16 comprise CKPDC, CPDC, PLC, and $\overline{L1\text{-}15}$. The outputs of the counter 16 comprise stages 2, 3, 4 and 16 PDC2, 3, 4 and PDC 16.

In operation one bit time after a dwell DWL low-to-high transition, PDC1-16 is cleared by CPDC during CPX. The first time, one bit time after the generation of the Hall low-to-high HLH signal, PLC gates $\overline{L1\text{-}15}$ into PDC1-15 during $\overline{CPX}$. During rise time, CKPDC is inhibited. At the end of the rise time, CKPDC resumes.

One bit time after the midpoint of the current limit adjust window, RMCL and $\overline{XCL}$ occurs. One bit time after RMCL and XCL, CKPDC is inhibited for 2 bit times. PDC1-16 is then cleared by a CPDC (CPX), PLC gates $\overline{L1\text{-}15}$ into PDC1-15 $\overline{CPX}$) and CKPDC then resumes.

At the end of the period HHLD and XCL occurs. One bit time after HHLD occurs, CKPDC is inhibited for 2 bit times, PDC1-16 is cleared by CPDC (CPX), PLC gates $\overline{L1\text{-}15}$ into PDC1-15 ($\overline{CPX}$) and CKPDC then resumes until PDC16 is set. When PDC 16 is set it starts dwell provided that the required minimum burn-time has elapsed.

If the period ends before midpoint, PLC loads $\overline{L1\text{-}15}$ into PDC1-15, the contents of the PDC are OR'd with the 1's compliment of the MUX latches. As previously described the net result of the Bias must increase the count of the PDC by at least 1 bit.

The 3-volt regulator 53 in the linear section 102 comprises a conventional design using a bandgap reference. It can supply a load current of 20 mA and has a drop-out voltage of less than 1 volt.

Figure 3:
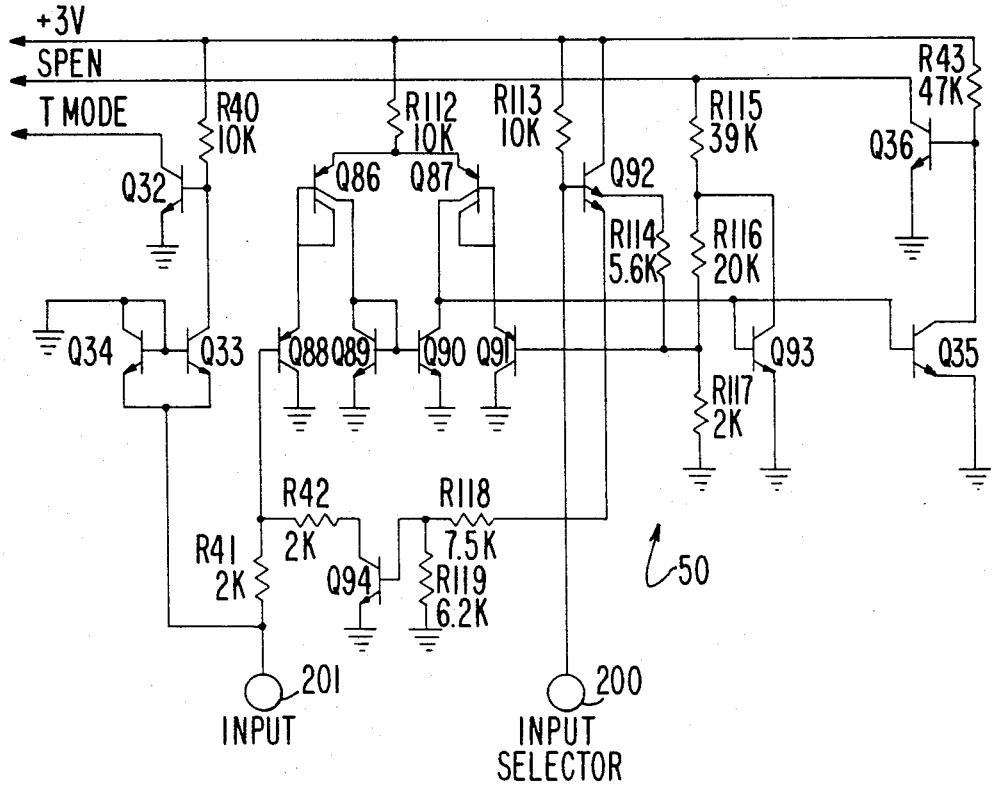
FIG. 3 is a schematic of an input amplifier and test mode control circuit according to the present invention.

Referring to FIG. 3, the input amplifier in the input amplifier and test mode control circuit 50 can operate in either of two mode which are controlled by an input selector terminal 200. One mode is suitable for Hall sensor pickups and the other for magnetic coil pickups coupled to an input terminal 201.

When the input selector terminal 200 is left open, the input characteristics are optimum for a Hall sensor pickup; the input impedance is low, and the input threshold voltages are about 1.4 volts above ground with a small amount of hysteresis. If the input selector terminal 200 is grounded, the input characteristics are suited to a magnetic coil pickup; the input impedance is high, the lower input threshold voltage is at ground potential, and the upper input threshold is 100 mV above ground potential.

In the Hall sensor pickup mode, operation of the input amplifier is as follows: The input selector terminal 200 is open, and a charge of three volts is applied to the base of Q92 through resistor R113. One emitter of Q92 turns Q94 on through resistor R118. One end of R42 is thus grounded through Q94. R41 and R42, in series, provide a low impedance at the amplifier input. The junction of R41 and R42 drives into the base of Q88 of the high gain differential amplifier consisting of transistors Q88 through Q91 and resistor R112. A feedback voltage from the resistive network R114 through R117 feeds into the base of Q91, the other input of the high gain differential amplifier. The input into the base of Q91 determines the upper and lower threshold voltages of the amplifier. As the input voltage approaches the upper input threshold voltage, the amplifier output from the collector of Q90 is LOW and transistors Q93 and Q35 are OFF. When the input voltage, divided down by R41 and R42, reaches the upper threshold established by the network R114 through R117, the output of the amplifier goes HIGH, turning Q93 and Q35 ON. Q36 is turned OFF because base current through R43 is diverted to ground through the collector of Q35. The SPEN output thus goes HIGH. A lower threshold reference voltage is now establihsed at the base of Q91 because the junction of R115 and R116 is grounded through the collector of Q93. The amplifier ouput and the SPEN signal go LOW again when the amplifier input voltage drops below the lower threshold reference voltage.

Transistors Q33 and Q34 serve two purposes. In normal operation, their reverse biased base-emitter junctions serve as high-frequency noise suppression capacitors.

For test purposes, sufficient current is pulled out of the input terminal to bring the base-emitter junctions of Q33 and Q34 into conduction. With sufficient current in Q33, current from R40 is diverted from the base of Q32 into the collector of Q33. Q32 is turned OFF, which commands the dwell control section to operate in a test mode in which the normal dwell output and tach output signals are replaced by the clock signal.

In the magnetic coil pickup mode, operation of the input amplifier is as follows: The input selector terminal 200 is grounded external to the IC which diverts current through R113 to ground and turns Q92 OFF. With Q92 OFF, Q94 is turned OFF since its base is now connected to ground through R119, and R114 is effectively removed from the feedback network which now consists of R115, R116 and R117. Since Q94 is OFF, the input impedance of the input amplifier is high for voltages in the range of one diode voltage drop below ground to one Zener breakdown voltage above ground, both voltages set by the emitter base junction of Q34. The input amplifier operates the same as in the Hall sensor pickup mode, except that the input threshold voltage levels are shifted because R114 is effectively removed from the feedback network. The upper threshold voltage, set by the reference voltage from divider R115, R116 and R117, is about 100 mV above ground. As the input increases above this voltage, the amplifier output goes HIGH, turning Q93 ON, thus reducing the reference voltage for the lower threshold voltage to ground, since the junction of R115 and R116 is connected to ground via the collector of Q93. The operation of the SPEN output transistor, Q35 and Q36, is the same as in the Hall sensor pickup mode, as is the operation of the test mode control circuit involving Q32, Q33 and Q34.

Figure 4:
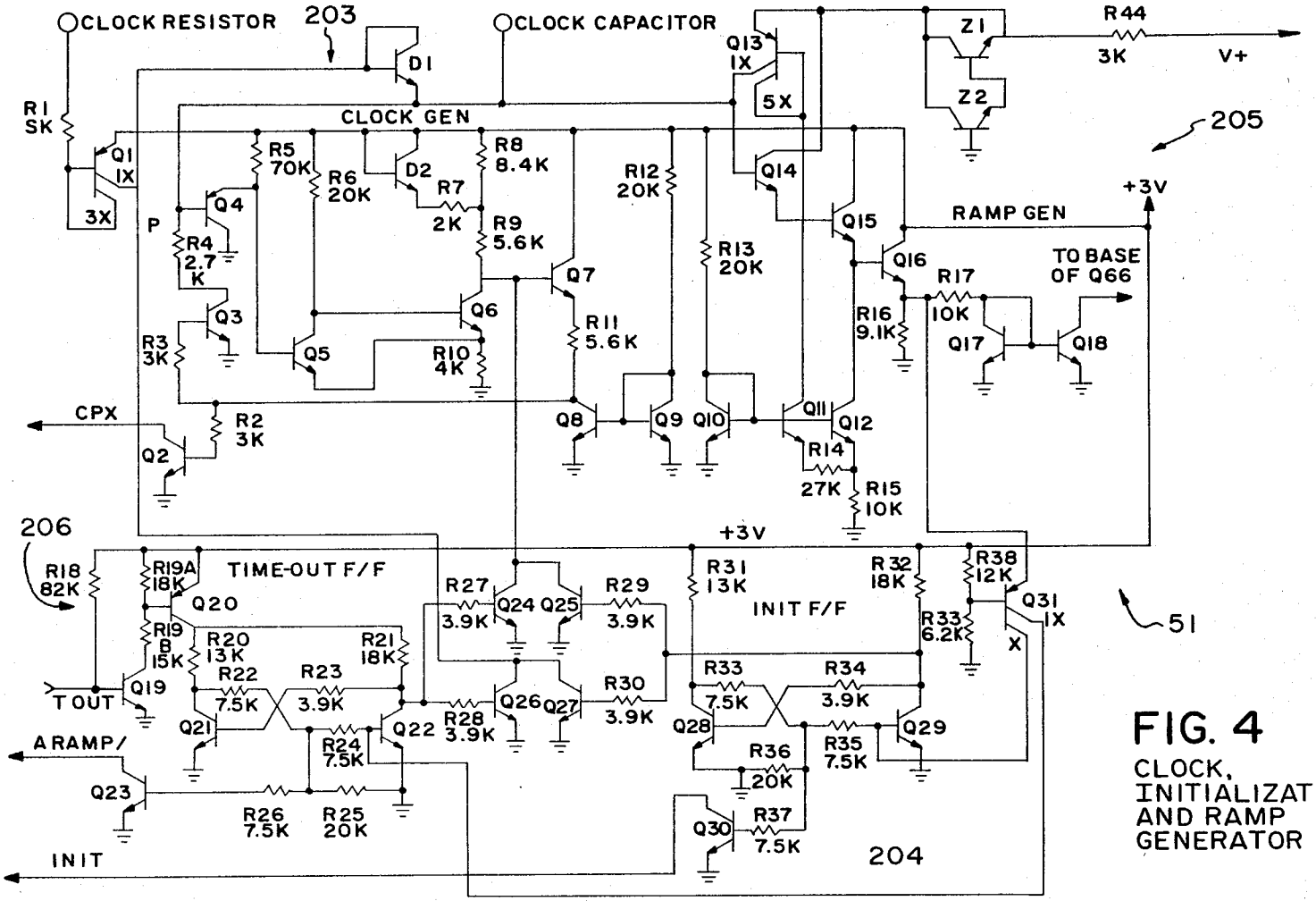
FIG. 4 is a schematic of a clock initialization and ramp generator circuit according to the present invention.

Referring to FIG. 4, the clock, initialization and ramp time-out generation circuit 51 uses the single external capacitor C4 to generate the clock signal CPX in a clock circuit 203, the initialization pulse INIT in an initialization pulse circuit 204, and the ramp current signal in a ramp circuit 205 for time-out shut down. During the initialization pulse INIT and during the ramp time-out period prior to ARAMP, the clock CPX is disabled and its output is HIGH. When the clock operates, its output is a 25 kHz signal with an 85% HIGH duty cycle.

The initialization pulse INIT of roughly 20 mS duration, is generated when a supply voltage V+ is first applied to the IC. A ramp current is generated at the end of the time-out period and fed into an output current limit (OCLIT) amplifier 202 (FIG. 5) where it is used to slowly turn off the power Darlington transistor 104. A slow reduction in coil current is necessary to prevent an unwanted spark at the end of the time-out period.

The clock 203 uses a modified Schmitt Trigger circuit, connected in an oscillator loop. The Schmitt Trigger is comprised of transistors Q4 through Q6, resistors R5 through R10 and diode D2. Transistor Q4 is an input buffer, and diode D2 provides temperature compensation for the upper trigger threshold voltage. The voltage transition from the lower to the upper threshold is determined by a constant current charging an external 2200 pF clock capacitor. The charge current is from the current mirror Q1 through diode D1. The current in Q1 is set by resistor R1 in series with an external trimmed resistor which connects between the clock resistor terminal and ground.

When the voltage across the external capacitor reaches the upper threshold of the Schmitt Trigger, the rising output from the collector of Q6 is fed to the level shift circuit consisting of transistors Q7 through Q9 and resistors R11 and R12. The output of the level shift circuit, the collector of Q8, drives Q3 ON through base resistor R3. Q3 goes into saturation which provides a capacitor discharge path through R4. When the voltage across the capacitor decays to the lower threshold of the Schmitt Trigger, Q3 is turned OFF by the Schmitt Trigger output and the cycle repeats. The signal which drives Q3 ON and OFF also drives the clock output transistor Q2 ON and OFF through resistor R2. During the normal operation of the clock just described, transistors Q24 through Q27 are OFF, and the small current from current mirror Q13 has a negligible effect on circuit operation.

The initialization pulse is generated by the INIT flip-flop in circuit 204 when the supply voltage is first applied. The unbalanced INIT flip-flop, consisting of transistors Q28 and Q29 and resistors R31 through R36, comes on with Q28 ON and Q29 OFF, which turns Q25 and Q27 ON. With Q27 ON, the capacitor charge current from Q1 is diverted to ground and blocked by diode D1. Q25 forces the Schmitt Trigger output LOW, which turns Q3 OFF. Thus, the only path for charging the external capacitor is from current mirror Q13, which has an output of only about 200 nA. The current in Q13 is set up by a current sink consisting of transistors Q10, Q11 and Q12 and resistors R13, R14 and R15. The small current from Q13 into the external capacitor produces a slow ramp voltage which is buffered through Q14, Q15 and Q16 and applied to the emitter of PNP transistor Q31.

The base of Q31 is set at 1 volt by the resistive dividers R38 and R39 connected between the regulated 3-volt line and ground. When the ramp voltage at the emitter of Q31 is sufficient to bring it into conduction, Q31 turns Q29 ON and causes the INIT flip-flop to change state. Q25 and Q27 turn OFF, and the circuit operates as a clock generator. The state of the INIT flip-flop controls Q30, which feeds into the dwell control seciton 13. Q30 is OFF for about 20 mS following the application of the supply voltage, and thereafter remains ON.

A ramp time-out current is generated in a time-out circuit 206 when the signal into the base of Q19 goes HI turning Q19 ON. Q19 turns Q20 ON through resistors R18 and R19. Q20 applies voltage to the TO (Time-Out) flip-flop consisting of transistors Q21 and Q22 and resistors R20 through R25. The TO flip-flop is unbalanced (as is the INIT flip-flop) and thus comes on in a predetermined state; Q21 ON and Q22 OFF. Q24 and Q26 are turned ON, which stops the clock and allows a ramp voltage to develop on the capacitor in the same manner as occurred during the initialization time. The ramp voltage at the emitter of Q16 is fed into current mirror Q17 and Q18 through R17. A current ramp into the collector of Q18 is coupled to R87 in the OCLIT amplifier circuit 202 (FIG. 5). The ramp current through R87 causes a ramp offset voltage in the OCLIT (output Current Limit) amplifier which slowly turns off the external power Darlington transistor, thus slowly reducing coil current. The ramp time-out is completed when the voltage at the emitter of Q16 is sufficient to turn Q22 on through Q31. The TO flip-flop is set into its other state, shutting Q24 and Q26 OFF and allowing the clock to operate again. At the completion of the ramp time-out, Q23 is turned ON through R26. Q23, and output to the dwell control section, remains ON until the input of Q19 goes LO, removing voltage to the TO flip-flop.

The supply current to the clock generator flows through R44. This resistor, in conjunction with Zener diodes Z1 and Z2, limit the maximum supply voltage for the clock generator to about 15 volts.

Referring to FIG. 5, the output driver, OCLIT, load dump, clamp, and tach output circuit 52 responds to the DWELL output from the dwell control circuit 13, driving the external Darlington 104 into saturation at the beginning of the dwell period, putting full battery voltage across the inductive coil load in the Darlington collector. A resistor network R206–R209 (FIG. 1) in the emitter of the Darlington senses the rise in current in the inductive load, and a voltage from this network is applied to the OCLIT (Output Current Limit) terminal 15. When the OCLIT voltage reaches a 130 mV threshold established within the OCLIT circuit 202, the OCLIT circuitry reduces the drive to the Darlington 104, taking it out of saturation and holding the coil current constant for the remainder of the dwell period. The sense resistor network R206–R209 is trimmed for a coil current limit of 7.5 A. At the end of the dwell period, the Darlington 104 is turned OFF, and the stored energy in the coil produces a high voltage firing pulse in the coil secondary.

Operating details of the output section are as follows: The output of the dwell control section 101 is HI during dwell time turning Q56 ON. The current in load resistor R67 is diverted to ground through the collector of Q56, thus removing drive to Q58 and Q59. When Q59 is OFF, the current through R70 flows into R71 and R72 turning Q60, Q62 and Q63 ON. With Q62 ON, the load current in Q74 is diverted from the base of Q61 into ground, turning Q61 OFF. Current from the PNP current source Q50 then flows into the base of the predriver transistor Q72, saturating it and the output transistor Q73, which is driven from the emitter of Q72 through resistor R94.

The current from Q50 is from the current mirror transistor set, Q49 and Q50, with degeneration resistors R57 and R58. The degeneration resistors raise the output impedance of the current mirror making its output insensitive to V+ potential variations. The current in the mirror Q49 and Q50 is set up by transistor Q51. At low supply voltages (V+ below about 11 volts), Zener diode Z9 is not in conduction, and there is conduction through both emitters of Q51. The collector current in Q51 is the sum of the currents in the two emitter resistors R55 and R56. At high supply voltages where less gain is desirable in the OCLIT amplifier, Zener diode Z9 comes into conduction and biases one emitter of Q51 OFF through the resistive divider, R54 and R55. Thus, at high supply voltages, the current through Q51 is only the current through resistor R56.

The collector load for Q72 has three components:

A resistor (R63) which connects to V+ potential

A resistor (R64) which connects to the base of Q53

The output from the PNP current mirror Q54

The major current into Q72 is supplied through R63, but at low temperatures and low battery voltage, additional current is needed through Q72 into Q73 to drive the external Darlington into full saturation. The extra current required is supplied from Q54. The current into current mirror Q54 is set up by transistor Q55 and emitter resistor R65.

Two transistors, Q78 and Q79, are stacked on the collector of the driver transistor, Q73, to: (1) Reduce the maximum OFF voltage across any of these transistors; (2) switch the load resistance as a function of supply to limit the maximum collector current through any of these same transistors.

Transistor Q79 is always turned ON when Q73 is ON; whereas Q78 is ON only when both Q73 is ON and when the V+ supply is below about 14 volts. Base drive to Q79 is through R104. The base voltage of Q79 is limited to a maximum value of two Zener voltages established by Z11 and Z12. Thus, Q79 will never force the collector of Q73 to a voltage greater than two Zener voltages. The base of Q78 is driven from the PNP current mirror Q77. Current to drive Q77 is through resistor R102 into the collector of Q76. Transistors Q75 and Q76 with resistors R100 and R101 form a Schmitt Trigger. The Schmitt Trigger is turned ON by a network connected to the V+ supply. The network, consisting of Z10A, Z10B, R98 and R99, feeds into the base of Q75. Transistor Q75 is turned ON when the V+ supply exceeds about 15 volts. Due to hysteresis of the Schmitt Trigger, Q75 does not turn OFF until the V+ supply is reduced to about 14 volts.

The load resistors R5, R6 (FIG. 1) for Q78 and Q79 are external because their power dissipations are too high to be allowed on the IC. When the V+ supply is below about 14 volts, the resistor R5 connected between the Collector I terminal 18 and the external battery supply diode becomes the load for Q78. Above a V+ supply of 15 volts, Q78 is OFF, and the load for Q73 is the resistor R6 between Collector I terminal 18 and Collector II terminal 17 in series with the resistor R5 connected between the Collector I terminal 18 and the external battery supply diode.

A high-current diode, D5 is connected between the Collector I terminal 18 and V+ terminal. It protects the IC by clamping the potential on Collector I terminal 18 and Collector II terminal 17 to one diode drop above the V+ potential if a positive transient voltage appears on the battery side of the external load resistor connected to the Collector I terminal 18.

A resistor (R95) is connected between the base and emitter of Q73 providing a leakage path for Q72 and Q73 to ensure that Q73 turns fully OFF at high temperatures when base drive is removed from Q72. Resistor R96 between the driver output terminal and ground likewise provides a leakage path from the Darlington input to ground to ensure that it also turns fully OFF when driver Q73 is OFF.

In the OCLIT circuit 202, the 130 mV, temperature-compensated reference voltage for the OCLIT circuit, is set by the network consisting of diode D4 and resistors R77 through R84. The reference voltage is taken from this network through R85 to the base of Q67. The temperature dependence of the voltage across D4 gives the 130 mV reference a positive temperature coefficient TC, which compensates for the positive TC of the external OCLIT sense resistor R206 in the emitter of the external Darlington output transistor Q201.

When the current in the external Darlington is low, the potential at the OCLIT terminal 15 is below the OCLIT reference voltage and all of the current from Q50 of the PNP current mirror, Q49 and Q50, flows into the base of Q72. As the Darlington current increases, the OCLIT voltage rises until it reaches the OCLIT reference voltage of 130 mV. At this potential, Q65 and Q67 are brought into conduction by application of the collector voltage of Q66 through R86 to the base of Q65. Collector current into Q65 diverts current away from the base of the predriver, Q72, thereby controlling the amount of drive current available from the output driver Q73. The OCLIT feedback loop is thus closed, and the Darlington current is held constant for the remainder of the dwell period.

The collector of transistor Q64 provides the CLON output signal to the current limit control circuitry 8. Q64 is held ON except when the OCLIT loop is closed. Prior to the dwell period, the collector of Q59 is low. The voltage on the base resistor, R71, of Q63 is low and Q63 is held OFF. Current through R75, which connects to the 3-volt regulated supply, flows through R76 into the base of Q64, turning Q64 ON.

During the dwell period, the collector of Q59 is high. The base of Q63 is turned ON by the voltage applied through R71. Q63 saturates, clamping the junction of R75 and R76 to ground. Because Q72 is fully turned on at the beginning of the dwell period before the OCLIT circuitry operates, Q72 saturates and its collector is about 3 volts (the sum of the Darlington VBE, the VBE of Q73 and the VBE of Q72) above ground. Transistor Q53 is turned on by the current out of its base, through R64, into the saturated collector of Q72. Q53 saturates, pulling the upper end of resistor R62 to the V+ supply.

Current through R62 flows into R76 which develops a voltage at their junction and the baee of Q64, which turns Q64 ON. As the OCLIT circuit comes into operation, the current in the predriver Q72 is drastically reduced to less than that available from current mirror Q54. Q72 comes out of saturation, and the output of current mirror Q54 saturates. The voltage thus applied to the base of Q53 through resistor R64 is below the VBE threshold of Q53, and Q53 turns OFF. The current in R62 drops to zero, and Q64 is turned OFF, since its base voltage (established through R76) is held low by saturated transistor Q63.

At low battery voltages, there is insufficient current flowing out of the base of Q53 to hold it ON even though the OCLIT circuit does not come into operation at low supply voltages (below about 7 volts). To prevent Q64 from being OFF at low battery conditions, even though the OCLIT loop is not operating, the circuitry associated with Q52 is included. A temperature compensated divider consisting of D7, D8, R59 and R60 is connected between V+ potential and ground. The junction of R59 and R60 connects to the base of Q52, and the emitter of Q52 is regulated at 3 volts. When the V+ potential drops below 5.3 volts, the potential at the junction of R59 and R60 drives the base of Q52 ON. Q52 saturates, and the top end of resistor R61 is connected to the 3-volt regulated supply. The current through R62 flows into R76, developing sufficient voltage at the base of Q64 to turn it ON.

During dwell time, the collector of Q56 is LOW. Q58 and Q59 are held OFF. Q60, the tach output sink transistor, is turned ON by the current through load resistor R70 and base resistor R72. The tach output 10, therefore, is LOW during dwell time. During the predwell period Q56 is OFF and Q58 and Q59 are ON. Q60 is OFF. When Q58 is ON its collector is LOW which connects resistor R69 between the emitter of Q57 and ground. The current through R69 flows from the collector of Q57 which sets up the current in current mirror Q48. The output of Q48 provides a source current out of the tach output terminal 10. The maximum output voltage at the tach output terminal 10 is limited by the Zener voltages of Z4 and Z5. These Zeners also protect the IC from excessive voltages due to static discharges into the tach output terminal 10.

At the end of the dwell period, the dwell signal turns OFF Q72, Q73 and the external power Darlington transistor. The current in the coil is interrupted and the stored energy causes the voltage on the collector of the Darlington transistor to rise to a very high voltage. To prevent possible damage to the Darlington transistor, its collector voltage is limited to a safe value by a clamp loop 207. External to the IC, the Darlington transistor collector voltage is divided down by resistors 204, 205 and applied to the clamp terminal 14 of the IC. When a certain voltage is reached at the clamp terminal 14, the temperature-compensated Zener network between it and the base of Q74 breaks down, causing Q74 to drive the Darlington transistor into conduction, thus limiting its peak collector voltage. The temperature-compensated Zener network consists of Z13, Z14, Z15, R97, R110, R111, D6 and Q85.

The MPT (Missing Pulse Threshold) detector 208 generates a HIGH signal for use in the MUXLATCH and PDC control circuit 14 when coil current exceeds 5.5 A, 73 percent of its final limiting values of 7.5 A. Current in the coil is sensed as a voltage across the external sense resistor R206 in the emitter of the external power Darlington transistor Q201. The sensed voltage is divided down and appears at the OCLIT terminal 15 of the IC, where it is fed through R88 into the emitter of the voltage comparitor consisting of transistors Q69 and Q70 and resistors R89 through R93. Seventy-three percent (73%) of the OCLIT reference voltage (Developed across the resistive divider, R81, R82 and R83 in series with R84) is applied to the emitter of Q70. When the emitter voltage of Q69 exceeds the emitter voltage of Q70, Q70 turns ON, shutting Q71 OFF, thus generating a high signal at the collector of Q71 when coil current exceeds 5.5 A.

Figure 6:
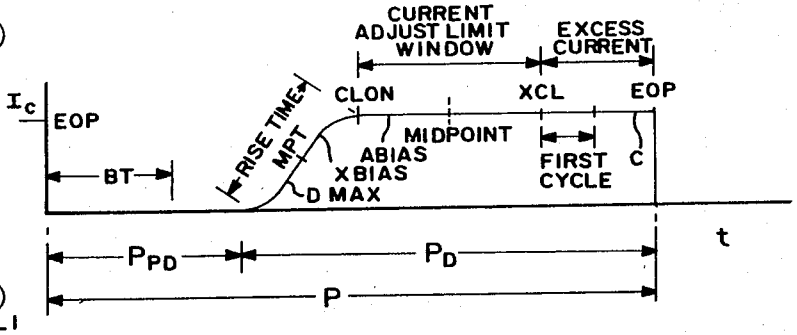
FIG. 6 is a diagram of coil current $I_C$ versus time t according to the present invention.

Referring to FIG. 6, there is shown a plot of ignition coil current $I_C$ versus time t during an ignition period P. The period P, the end of which is designated EOP, corresponds to the time between the termination of a system dwell DWELL and the termination of a following adjacent system dwell DWELL. The dwell period, corresponding to the time the ignition coil is charged, is designated $P_D$. The pre-dwell period, corresponding to the time between the start of a period and the start of a DWELL, is designated $P_{PD}$. The minimum burn-time period corresponding to the time of fuel combustion, is designated BT. A coil current of approximately $5\frac{1}{2}$ amps is designated missing pulse threshold MPT. A coil current of approximately $7\frac{1}{2}$ amps is designated current-limit-on CLON. A current-limit-on period, corresponding to a constant coil current of $7\frac{1}{2}$ amps, a current limit adjust window, and an excess current limit period, follows CLON.

The current limit adjust window is shown having a first and a second half separated by a broken line designated midpoint. The end of the current limit adjust window and the beginning of the excess current limit period is designated excess current limit XCL. The first 8 bits of the excess current limit period are designated FIRST CYCLE. The end of the excess current limit period and indeed, the termination of the DWELL is designated end-of-period EOP. The first half of the current limit adjust window is designated as A BIAS window. The time between MPT and CLON is designated an XBIAS window. The time between the start of a dwell and MPT is designated a DMAX window.

As will be apparent, the termination of a system dwell which results from a SPEN high-to-low transition in response to a corresponding Hall sensor output can, in any given period, occur at any time following the start of the period. Indeed, the length of a pre-dwell period and the time of the start of the dwell in a period depends on when the previous dwell ended relative to the beginning of the previous period, but in no event, can a dwell start before the termination of the minimum burn-time BT established for that period.

In operation, when power is first applied to the system, e.g., ignition switch turned on, the INIT signal is generated. The INIT signal resets the DWL, LDWL and TOUT flip-flops and sets the CDWL flip-flop. The system then waits for the first SPEN low-to-high transition, i.e., HLH. The HLH and CDWL signals generate the GO signal.

$$GO = HLH \cdot CDWL$$

The GO signal sets the DWL flip-flop to turn on the first system DWELL.

At the start of the first DWELL the complement of the PC, which was previously cleared by the CDWL flip-flop, is transferred to the PDC, placing all 1's in the PDC and the initial output of the RPM detector corresponds to one of the four engine speed ranges, e.g., 0–500, 500–1500, 1500–3000, above 3000 RPM, depending on which of the holding flip-flops therein were set after power was applied. The initial output of the RPM detector determines the length of the current limit adjust window for the period. During the rise time, the time the coil is charging, the PDC is inhibited, the CLC is cleared and inhibited and the PC starts counting. In response to the counting of the PC, the sense flip-flops in the RPM detector determine the approximate average speed of the engine during the period.

At the end of the first rise time, the DWELL enters the current limit adjust window period and the PDC and CLC start counting. While the CLC is counting, the output of the CLC is compared with the initial output of the RPM detector to fix the time when the PDC has counted "down" to the midpoint of the current limit adjust window. When the PDC has counted "down" to the midpoint of the current limit adjust window, the PDC is complemented and the CLC is cleared. The PDC and CLC then resume counting. When the PDC has counted "up" to the end of the current limit adjust window, as again determined by a comparison of the output of the CLC and initial output of the RPM detector, the PDC enters the excess current limit period. During the first cycle of the excess current limit period, i.e., the first eight bit times, the PDC countines to count "up" at the normal 25 kHz clock rate. After the first cycle, under the control of the CLC, the PDC continues to count "up" but at the rate of one out-of-eight clock pulses until the end of the period. The end of the period occurs when the system DWELL is terminated by a SPEN high-to-low transition (EHHL).

At the end of the first period, the output of the RPM detector contains the approximate average speed of the engine during the period which determines the length of the current limit adjust window for the second or next period, the complement of the contents of stages 5–8 of the PC is transferred to the BTC, after which the PC is cleared, the contents of the PDC are complemented and the BT flip-flop is set.

At the beginning of the second period, the PC and PDC start counting. When the PDC has counted out, i.e., PDC 16 is set, the DWELL in the second period starts provided that the minimum burn time has elapsed. The elapsing of the minimum burn-time is indicated by the resetting of the BT flip-flop.

The time of the resetting of the BT flip-flop depends on the output of the RPM detector at the end of the previous period. If the output of the RPM detector at the end of the previous period corresponded to an average speed above 3000 RPM, then the BT flip-flop is reset by the output BTTC of the BTC. If the output of the RPM detector at the end of the previous period corresponded to an average speed of less than 3000 RPM, then the BT flip-flop is reset by the output of stages 4 and 7 of the PC.

If BT is reset by BTTC, the length of the minimum burn-time is approximately 25% of the length of the previous period. This is due to the fact that at the beginning of the second period, $\overline{PC5\text{–}8}$ were transferred to the BTC (PC9 corresponds to 3000 RPM) and thereafter the BTC was counted out using PC2.

If BT is reset by PC4 and 7, the length of the minimum burn-time is approximately 3 ms. Stated in other words, it may be noted, that the length of the minimum burn-time is 25% of the length of the previous period or 3 ms; whichever is less.

At the start of the DWELL in the second period, the events described above with respect to the start of DWELL in the first period are repeated. The complement of the contents of the PC, which now correspond to the length of the pre-dwell period in the second period, are transferred to the PDC.

During the rise time, the PDC is inhibited, the CLC is cleared and inhibited and the PC continues counting.

At the end of the rise time, the PDC and CLC start counting. While the CLC is counting, the output of the CLC is again compared with the output of the RPM detector to fix the time when the PDC has "counted down" to the midpoint of the current limit adjust window. But this time and during subsequent periods it is the output of the RPM detector existing at the end of the first or preceding period that is used. The output of the RPM detector existing at the end of the first or preceding period corresponds to the approximate average engine speed during the first or preceding period to establish the length of the current limit adjust window for the second or current period.

For each of the four average speed ranges employed, the length of the current limit adjust window is as follows:

| SPEED RANGE (RPM) | LENGTH (msec) |
|---|---|
| 0–500 | 5.12 |
| 500–1500 | 1.92 |
| 1500–3000 | 0.64 |
| above 3000 | 0.32 |

When the PDC has counted "down" to the midpoint of the current limit adjust window, the PDC is again complemented and the CLC is cleared. The PDC and CLC then resumes counting. When the PDC has counted "up" to the end of the current limit adjust window as determined by the CLC, the PDC enters the excess current period and continues counting "up", as described above, until the DWELL is terminated by a SPEN high-to-low transition.

At this point, it may be apparent that if the system DWELL had terminated, i.e, the end of the period occurred, at the end of the current limit adjust window, i.e., at the end of the second half of the current limit adjust window, the number of "up" counts in the PDC occurring during the second half of the current limit adjust window would equal the number of "down" counts in the PDC which occurred during the first half of the current limit adjust window. In this event, the length the pre-dwell period in the next period would equal the length of the pre-dwell period in the current period. On the other hand, if the end of the period occurred during the excess current limit period, the number of "up" counts in the PDC would be greater than the number of "down" counts occurring during the first half of the current limit adjust window. In that event, the complementing of the PDC at the end of the period and the subsequent counting "down" of the PDC during the pre-dwell period of the next period would take longer than it did during the current period. The effect of the longer count down is to lengthen the next pre-dwell period, i.e., increase the dwell angle, and thereby start the next DWELL relatively later. This will effectively shorten the next dwell if there has been no decrease in engine speed during the next period.

Of course, the magnitude of the increase of the next pre-dwell period depends on whether the current period ended during the first cycle of the excess current limit period or after the first cycle when the PDC was counting only one out-of-eight bit times. If the period ended after the first cycle of excess current limit, the length of the next pre-dwell period is enlarged but only by one additional bit time for each eight-bit cycle following the first cycle. This reduced lengthening of the pre-dwell period is called "proportional walk-back." The "proportional walk-back" feature of the present invention was adopted to avoid an excessively long pre-dwell due to an excessively long excess current period in a preceding period as might occur during a rapid deceleration.

If on the other hand, the end of a current period occurs during the second half of its current limit adjust window, then the number of "up" counts in the PDC will be less than the number of "down"0 counts which occurred during the first half of the current adjust window. In that event, the time it takes to count out the PDC after the beginning of the next period will be relatively shorter thereby shortening the next pre-dwell period. The amount by which the next pre-dwell period will be shortened will be equal to the difference between the length of the first half of the current limit adjust window and the number of "up" counts which occurred during the second half of the current limit adjust window before the end of the period.

If the end of a period occurs before the midpoint of its current limit adjust window as may occur during rapid acceleration, one of three bias conditions is established. An ABIAS condition is established if the period ends during the first half of the current limit adjust window. An XBIAS condition is established if the period ends during rise time after the coil has charged to an energy level of $5\frac{1}{2}$ amps. A DMAX condition is established if the period ends at any time before the coil has charged to an energy level of $5\frac{1}{2}$ amps. In FIG. 6, the $5\frac{1}{2}$ amp level is designated the missing pulse threshold (MPT) level.

When one of the three bias conditions is established, the PDC is not complemented at the end of the period as described above. What occurs is that at the end of the period, the contents of the PDC are augmented by an injection of ABIAS, XBIAS or DMAX, as appropriate. The amount of ABIAS, XBIAS and DMAX used depends on the average speed of the engine during the period. If the ABIAS condition is established and the average engine speed during the period was above 3000 RPM, the first four stages PDC1–4 of the PDC are injected to contain all 1's if the engine speed was below 3000 RPM, the first six stages PDC1–6 of the PDC are injected with all 1's. If XBIAS is established, the first eight stages PDC1–8 of the PDC are injected with all 1's. If DMAX is established, the first fifteen stages PDC1–15 of the PDC are injected with all 1's.

There may be an occasion when the BIAS condition is established and PDC 2, 3 and 4 are already set. In that event, the injection of the BIAS as described above might possibly have no effect. This situation would occur if all 1's were loaded on top of all 1's for the stages of PDC affected by the BIAS in question. To avoid this condition, whenever a BIAS condition is established and PDC 2, 3 and 4 are already set, the injection of the BIAS is delayed two-bit times to permit the PDC counter to be incremented by an amount sufficient to insure that the injection of the BIAS will result in increasing the count of the PDC by at least one bit.

In any event, it may now be apparent that when bias is established, the injection of bias in the PDC at the beginning of a period will result in the PDC counting out earlier than it did during the preceding period thereby shortening the next pre-dwell period and starting the next DWELL sooner. It may be recalled, however, that in no event can a DWELL start before the minimum burn-time has elapsed.

If the end of a period occurs at the midpoint of its current limit adjust window, the PDC is not complemented and Bias is not established. In that event, the length of the next pre-dwell simply corresponds to the time it takes to count out the PDC.

From the foregoing it should now be clear that what is disclosed is a novel means responsive to engine speed for providing a predetermined burn-time period, means for providing a pre-dwell signal at the end of a pre-dwell period in said period at a time determined by the length of the dwell in the preceding period, and means responsive to the termination of said burn-time period and said pre-dwell signal for starting a dwell in said period.

It may occur that an engine stalls with the ignition switch turned on and the DWELL high. To prevent premature destruction of the output circuits of the system, inactively on the output of the Hall sensor, i.e, no SPEN high-to-low transition, for a period of 1.3 seconds as indicated by an output from the PC, will set the TOUT flip-flop. The setting of the TOUT flip-flop will provide a signal to the linear section. In response to the TOUT signal, the linear section inhibits the system clock for 20 milliseconds, slowly discharges the ignition coil and generates the ARAMP signal. The ARAMP signal prevents a DWELL signal after the system clock resumes until a SPEN low-to-high transition occurs. After the system clock resumes the TOUT flip-flop will set the CDWL flip-flop, which in turn will reset the DWL flip-flop. The generation of a SPEN low-to-high transition, i.e., HLH and the concurrence of a CDWL signal generates the GO signal $$GO = HLH \cdot CDWL$$

The GO signal sets the DWL flip-flop to start the next dwell and the system continues to function as described above.

While a preferred embodiment of the present invention is disclosed and described above, it is contemplated that various changes may be made thereto by those skilled in the art without departing from the spirit and scope of the present invention. Accordingly, it is intended that the scope of the present invention not to be limited to the embodiment described but be determined by reference to the claims hereinafter provided and their equivalents.

What is claimed is:

1. An engine ignition apparatus for an engine having an ignition coil and period which extends from the termination of a dwell to the termination of the next dwell comprising:

means responsive to engine speed for providing a predetermined burn-time period, said predetermined burn-time period of time comprising a fixed period of time if the average engine speed during the preceding period was equal to or less than a predetermined RPM and a time equal to a predetermined percentage of the length of the preceding period if the highest engine speed during said preceding period was greater than said predetermined RPM;

means for providing a pre-dwell signal at the end of a pre-dwell period in said period at a time determined by the length of the dwell in the preceding period; and means responsive to the termination of said burn-time period and said pre-dwell signal for starting a dwell in said period.

2. An apparatus according to claim 1 wherein said pre-determined burn-time period comprises a fixed period of time or a time equal to a predetermined percentage of the length of the preceding period, whichever is less.

3. An apparatus according to claim 2 wherein said fixed period of time is approximately 3 milliseconds and said pre-determined percentage is approximately 25%.

4. An apparatus according to claim 1 wherein said burn-time signal generating means comprises a first counting means for providing said burn-time signal at a fixed period of time after the beginning of said period if the average engine speed in the preceding period is equal to or less than a predetermined RPM and a second counting means for providing said signal after a period of time equal to a predetermined percentage of the length of the preceding period if the average engine speed in the preceding period is more than said predetermined RPM.

5. An apparatus according to claim 1 wherein said preceding period comprises a first preceding period and said pre-dwell signal providing means comprises: means for lengthening said pre-dwell period if the length of the dwell in said first preceding period is longer than the length of the dwell in the period preceding said first preceding period and means for shortening said pre-dwell period if the length of the dwell in said first preceding period is shorter than the length of the dwell in the period preceding said first preceding period when the speed of the engine during each of said periods is within a predetermined range of engine speeds.

6. An apparatus according to claim 5 wherein said pre-dwell signal providing means comprises: means responsive to the length of the dwell in said preceding period for lengthening said pre-dwell period if the length of the dwell in said preceding period exceeds a predetermined length and means for shortening said pre-dwell period if the length of the dwell in said preceding period is less than a predetermined length.

7. An apparatus according to claim 1 wherein said pre-dwell signal providing means comprises:

means responsive to the speed of said engine at the end of said period preceding said preceding period for providing a current limit adjust window of a predetermined length for said preceding period having a first half and a second half; means for lengthening said pre-dwell period if the termination of the dwell in said preceding period occurs after the termination of said second half of said window; and means for shortening said pre-dwell period if the termination of the dwell in said preceding period occurs before said termination of said second half of said window.

8. An apparatus according to claim 7 wherein said means for shortening said pre-dwell period comprises:

means coupled to said ignition coil for detecting whether the current in said coil has reached a first and a second predetermined magnitude during said preceding period; and means responsive to said detecting means and the termination of the dwell in said preceding period for providing a first bias signal for shortening said pre-dwell period if the termination of the dwell in said preceding period occurs during said first half of said window; a second bias signal for shortening said pre-dwell period if the termination of the dwell in said preceding period occurs when said current in said ignition coil has a magnitude between said first and said second magnitudes, and a third bias signal for shortening said pre-dwell period if the termination of the dwell in said preceding period occurs when said current in said ignition coil has a magnitude less than said first predetermined magnitude.

9. An apparatus according to claim 8 wherein said pre-dwell period shortening means comprises a pre-dwell counting means and means for presetting said pre-dwell counting means at the end of said preceding period by an amount corresponding to said first, said second and said third predetermined bias signals.

10. An apparatus according to claim 7 wherein said current limit adjust window providing means comprises means for providing a current limit adjust window of a different length for each of predetermined number of ranges of engine speeds.

11. An apparatus according to claim 10 wherein said four ranges of engine speeds comprise approximately 0–500 RPM, 500 to 1500 RPM, 1500 to 3000 RPM and above 3000 RPM.

12. An apparatus according to claim 1 comprising means for detecting when said engine has stalled for a predetermined length of time; means responsive to said detecting means for discharging said ignition coil at a rate sufficiently slow to prevent a spark and means for starting a dwell after said coil has been discharged.

13. An apparatus according to claim 7 wherein said means for lengthening said pre-dwell period comprises: means for lengthening said pre-dwell period by a first predetermined amount if said dwell is terminated before a predetermined period of time after the termination of said second half of said window and by a second predetermined amount if said dwell is terminated after said predetermined period.

14. An apparatus according to claim 13 wherein said predetermined period comprises a predetermined number of clock periods, said first predetermined amount is equal to said number of clock periods which elapse between the termination of said second half of said window and said termination of said dwell and said second predetermined amount comprises an amount equal to a predetermined percentage of the number of clock periods which occur between the termination of said predetermined period and said termination of said dwell.

15. An apparatus according to claim 7 wherein said means for shortening said pre-dwell period comprises:

means for shortening said pre-dwell period if the termination of the dwell in said preceding period occurs during said second half of said window where said shortening is an amount equal to the difference between the number of clock periods in said first half of said window minus the number of said clock periods which have elapsed from the beginning of said second half of said window and the termination of said dwell in said preceding period.

16. An ignition control apparatus for an internal combustion engine comprising:

means for providing a burn-time period, said means comprising means responsive to the average speed of said engine during a preceding period for providing a first burn-time period which has a length which is a predetermined prercentage of the length of said preceding period if the average speed of said engine during said preceding period exceeds a predetermined average speed and a second burn-time period which has a length which is a predetermined fixed length if the average speed of said engine during said preceding period is equal to or less than said predetermined average speed;

means for providing a pre-dwell period; and means responsive to said burn-time period providing means and said pre-dwell period providing means for starting a system dwell.

17. An apparatus according to claim 16 wherein said predetermined average speed is 3000 RPM, said first burn-time period providing means comprises means for providing a first burn-time period which has a length approximately equal to 25% of the length of said preceding period and said second burn-time period providing means comprises means for providing a second burn-time period which has a length approximately equal to 3 msec.

18. An apparatus according to claim 16 wherein said first burn-time period providing means comprises:

a burn-time counter;

a period counter having a plurality of stages for measuring the length of said preceding period;

means for loading said burn-time counter after the end of said preceding period with a number corresponding to the contents of predetermined stages of said period counter; and means for clocking said burn-time counter after said loading of said burn-time counter at a predetermined rate.

19. An apparatus according to claim 18 wherein said loading means comprises means for loading said burn-time counter with the complement of the contents of stages 5–8 of said period counter and said clocking means comprises means for clocking said burn-time counter with the output of the second stage of said period counter.

20. An apparatus according to claim 19 comprising: a burn-time flip-flop;

means for setting said burn-time flip-flop at the beginning of a period; and means responsive to the counting out of said burn-time counter for resetting said burn-time flip-flop.

21. An apparatus according to claim 16 wherein said second burn-time period providing means comprises:

a period counter having a plurality of stages for measuring the length of said preceding period; a burn-time flip-flop;

means for setting said burn-time flip-flop at the beginning of a period; and means responsive to the setting of predetermined stages of said period counter for resetting said burn-time flip-flop.

22. An apparatus according to claim 16 wherein said means for providing said pre-dwell period comprises:

means responsive to the average speed of said engine during a first period for establishing a current limit adjust window for a second period having a length corresponding to said engine speed, said second period including a pre-dwell period; and means responsive to the termination of said second period for providing a first pre-dwell period for a third period comprising a length of time which equals the length of said pre-dwell period in said second period if said second period terminates at the end of said current limit adjust window;

means responsive to the termination of said second period for providing a second pre-dwell period for said third period which is longer than said pre-dwell period in said second period if said second period terminates after the end of said current limit adjust window; and means responsive to the termination of said second period of providing a third pre-dwell period for said third period which is shorter than said pre-dwell period in said second period if said second period terminates before the end of said current limit adjust window.

23. An apparatus according to claim 22 wherein said second pre-dwell period providing means comprises:

means for establishing an excess current limit period for said second period comprising a first cycle and one or more succeeding cycles, the number of said succeeding cycles being dependent on when said second period terminates;

means for providing said second pre-dwell period comprising a first predetermined length if said second period terminates during said first cycle; and means for providing said second pre-dwell period comprising a second predetermined length if said second period terminates after said first cycle.

24. An apparatus according to claim 23 wherein said first cycle comprises a predetermined number of bit times and said means for providing said second pre-dwell period comprising said first predetermined length comprises means for providing said second pre-dwell period comprising a length of time which equals the length of time of said pre-dwell period in said second period plus a length of time corresponding to the number of bit times which occur between the end of said current limit adjust window and the termination of said second period.

25. An apparatus according to claim 23 wherein said first cycle comprises a predetermined number of bit times and said means for providing said second pre-dwell period comprising said second predetermined length comprises means for providing said second pre-dwell period comprising a length of time which equals the length of time of said pre-dwell period in said second period plus a length of time corresponding to said predetermined number of bit times in said first cycle and a length of time corresponding to a predetermined number of bit times for each of said succeeding cycles which occur prior to the termination of said second period.

26. An apparatus according to claim 25 wherein said first cycle comprises eight bit times and said predetermined number of bit times for each of said succeeding cycles comprises one bit time.

27. An apparatus according to claim 22 wherein said current limit adjust window establishing means comprises means for establishing a current limit adjust window having a first half a second half, and a midpoint dividing said first and said second half and said means for providing said third pre-dwell period comprises:

means for providing said third pre-dwell period comprising a first predetermined length of time if said second period terminates during said second half;

means for providing said third pre-dwell period comprising a second predetermined length of time if said second period terminates at said midpoint; and means for providing said third pre-dwell period comprising a third predetermined length of time if said second period terminates before said midpoint.

28. An apparatus according to claim 27 wherein said means for providing said third pre-dwell period comprising said first predetermined length of time comprises means for providing said third pre-dwell period having a length of time which equals the length of said pre-dwell period in said second period minus the time between the end of said second period and the end of said current limit adjust window established for said second period.

29. An apparatus according to claim 27 wherein said means for providing said third pre-dwell period comprising said second predetermined length of time comprises means for providing said third pre-dwell period having a length of time which equals the length of said pre-dwell period in said second period minus the length of said first half of said current limit adjust window.

30. An apparatus according to claim 27 comprising:

first means for detecting when the ignition coil of the engine has reached a first predetermined energy level;

second means for detecting when said ignition coil has reached a second predetermined energy level; and wherein said means for providing said third pre-dwell period comprising said third predetermined length of time comprises means for providing said third pre-dwell period having a first length of time if said second period terminates during said first half of said current limit adjust window, a second length of time if said second period terminates before said coil has reached said second predetermined energy level and a third length of time if said second period terminates before said coil has reached said first predetermined energy level.

31. An apparatus according to claim 30 comprising a pre-dwell counting means and wherein said means for providing said third pre-dwell period having said first, said second and said third lengths of time comprises biasing means for selectively changing the contents of said pre-dwell counting means for a first, a second and a third amount, respectively, in order to shorten said third pre-dwell period compared with the length of said pre-dwell period in said second period.

32. An apparatus according to claim 16 comprising:

means for indicating when said engine has ceased operating for a predetermined period of time;

means responsive to said indicating means for discharging an ignition coil; and means coupled to said discharging means for preventing a re-charging of said coil for a predetermined period of time after said coil has been discharged.

33. An apparatus according to claim 32 comprising:

an oscillator circuit coupled to a capacitive means for providing a system clock signal wherein said discharging means comprises:

means for inhibiting said oscillator circuit for a predetermined length of time; means coupled to said capacitive means for generating a ramp signal when said oscillator is inhibited; and means responsive to said ramp signal for discharging said ignition coil at a predetermined rate sufficient to prevent the generation of a spark from a spark plug coupled thereto; and wherein said preventing means comprises:

means responsive to the termination of said ramp signal and said indicating means for providing said predetermined period of time.

* * * * *